United States Patent [19]

Sato

[11] 4,240,348

[45] Dec. 23, 1980

[54] INK SUPPLY DEVICES FOR PORTABLE LABELING MACHINE

[75] Inventor: Yo Sato, Tokyo, Japan

[73] Assignee: Kabushiki Kaisha Sato Kenkyusho, Tokyo, Japan

[21] Appl. No.: 3,626

[22] Filed: Jan. 15, 1979

Related U.S. Application Data

[63] Continuation of Ser. No. 716,934, Aug. 23, 1976, abandoned, which is a continuation-in-part of Ser. No. 681,251, Apr. 28, 1976, abandoned.

[30] Foreign Application Priority Data

| | | | |
|---|---|---|---|
| Sep. 12, 1975 | [JP] | Japan | 50-109929 |
| Oct. 7, 1975 | [JP] | Japan | 50-120292 |
| Dec. 20, 1975 | [JP] | Japan | 50-151236 |
| Dec. 25, 1975 | [JP] | Japan | 50-154012 |
| Feb. 5, 1976 | [JP] | Japan | 51-010852 |

[51] Int. Cl.[3] ..... B41F 1/50; B41K 1/42

[52] U.S. Cl. ..... 101/295; 101/305; 101/315; 101/321; 101/330; 101/360

[58] Field of Search ..... 156/384; 101/287, 288, 101/291, 292, 295, 310, 301, 304, 305, 308, 314, 315, 326, 318, 320, 321, 324, 327, 328–330, 348, 350, 359, 360

[56] References Cited

U.S. PATENT DOCUMENTS

| | | | |
|---|---|---|---|
| 3,077,828 | 2/1963 | Brugge et al. | 101/56 |
| 3,359,894 | 12/1967 | Rydman | 101/348 |
| 3,787,266 | 1/1974 | Wada | 156/384 |
| 3,878,783 | 4/1975 | Hamisch, Jr. | 101/348 |
| 3,902,412 | 9/1975 | Pabodie | 101/288 |
| 3,902,952 | 9/1975 | Penalnna | 101/295 |

*Primary Examiner*—William Pieprz

*Attorney, Agent, or Firm*—Ostrolenk, Faber, Gerb & Soffen

[57] ABSTRACT

An ink supply device for use in a labeling machine: the ink supply device includes at least one inking roller; guide means on the frame of the labeling machine guide the inking roller to roll over the printing surface of a printing head; the guide means may comprise curved slots in or rails on the side plates of the machine frame; guide rollers that support the inking rollers are received in the guide means; in another embodiment, there are additional bearing plates attached at both ends of an inking roller; these plates are engageable with the lower end surfaces of the printing head; in other embodiments, two inking rollers are provided; each such roller is biased and guided in a different way; springs may bias both rollers toward the print surface, or only one roller; the roller may be guided to vertically shift over the print surface by a guide slot in the support carriage for the roller or by the slot of the guide means.

44 Claims, 57 Drawing Figures

INK SUPPLY DEVICES FOR PORTABLE LABELING MACHINE

RELATED APPLICATION

This is a continuation of application Ser. No. 716,934 filed Aug. 23, 1976, now abandoned which in turn is a continuation-in-part application of application Ser. No. 681,251 filed Apr. 28, 1976, now abandoned.

BACKGROUND OF THE INVENTION

The present invention relates to portable label printing and applying machines for printing and applying labels to commodities, and more particularly to ink supply devices for such labeling machines for uniformly inking the printing surface of a printing head.

Most labeling machines have a printing head. Most such machines include a device for supplying ink to the printing surface of the printing head. In most ink supply devices, an inking roller is attached to the leading end of a spring biased pivotally mounted arm. The inking roller rolls over the printing surface under spring pressure as it supplies the ink.

An inking device that relies upon spring pressure upon the inking roller has several drawbacks. Aging of the spring lessens its biasing force and reduces the pressure of the inking roller on the printing surface. This will cause deterioration of the ink application and in the printing quality. Imprinted indicia will be dimmed and may not print in part.

The weakened spring will cause less ink to be pumped from the inking roller. Such pumping occurs when the roller is allowed to bulge as it returns to shape from being depressed by the types. Ink which might otherwise be confined at the center portion of the roller is pumped out. The biasing force of the spring is liable to vary with the strength of the actuating force of the inking device. In the worst case, the inking roller may have no contact with the printing surface during the inking operation.

Abrupt gripping of an actuating hand lever may cause irregular contact of the inking roller on the printing surface. The resultant non-uniform inking is not suitable for printing the complex, detailed indicia, such as bar codes, that are now in use.

Recently, the so-called "POS (Point of Sale) System" has been developed. Information encoded in the form of characters, such as bar codes or OCR letters, are printed on labels to be applied to commodities. This information is later automatically read out by an optical character-reading machine which is connected to a computer. The operating material such as goods in stock, amount of sales, pursuit of customers by goods or gain calculations is recorded in and processed by the computer. Highly precise imprinting of labels is required in order that the characters be accurately read by the optical character-reading machine. For this reason, the ink supply to the printing surfaces of the printing heads should be adequate in quantity and uniformly distributed.

To properly ink all types in a plurality of print heads, it has become customary to use a plurality of inking rollers. Where only one inking roller is used for inking the plurality of printing heads, it is quite difficult to supply an adequate quantity of ink uniformly to all of the printing surfaces of the respective printing heads. This results in irregularities in the print.

In accordance with the recent developments in the portable labeling machine art, the ink supply step should be accomplished before the printing of a label by the printing head. The supplying of ink should be accelerated to permit higher speed printing. For this purpose, it is found difficult to effect sufficient supply of ink with use of a single ink-impregnated roller. Thus, at least two ink-impregnated rollers are useful in certain portable labeling machines.

Use of a number of rollers increases the gripping force required for gripping the hand lever to its full stroke and increases labeler operated fatigue. This problem occurs because the plural inking rollers have to roll over the printing surfaces and be depressed to the desired extent on their outer peripheries.

The gripping force required of the operator is increased in proportion to the scale and number of the depressions in the inking rollers which must be forcibly formed by the interactions between the types being inked and the inking rollers. The required gripping force may exceed the strength of the operator of the hand labeler.

One additional way to overcome the resistance to the motion of the inking roller is to cause it to move faster or to more rapidly grip and release the hand lever. If the hand lever is gripped and released at a high speed, the imprint on the labels is thinner than when the hand lever is gripped and released at a lower speed.

If there are irregularities in the diameters or shapes of the inking roller or if the roller diameters or shapes change as a result of use and wear or they are unpredictably enlarged during ink impregnating operation, it may be difficult to properly and uniformly supply ink to the printing surfaces with inking rollers.

SUMMARY OF THE INVENTION

It is the primary object of the present invention to provide an improved ink supply device for use in a labeling machine, which device has none of the drawbacks of an inking device that uses a biasing spring for pressing its inking roller against a printing surface.

Another object of the present invention is to provide an ink supply device of the above type, in which the inking roller is depressed to a predetermined depth upon contacting the printing surface of a printing head and in which the inking roller is squeezed under a predetermined suitable pressure.

It is a further object of the invention that the foregoing be accomplished despite deformation, wear and non-uniformity of the shapes of the inking rollers.

Still another object is to provide an ink supply device of the above type for uniformly supplying ink to the printing surface of a printing head.

Another object of the present invention is to provide an ink supply device of the above type, in which the pushing force of the inking roller against the printing surface of a printing head is so regulated that the ink at the center portion of the inking roller may ooze or be pumped to the outer surface of the roller to thereby make the ink supply last longer and to make the ink application properly uniform.

A further object of the present invention is to provide an ink supply device of the above type, by which a large number of labels can be precisely printed without any shading of the imprint for a prolonged time period.

A further object of the invention is to provide an ink supply device of the above type which ensures precision inking and printing for a prolonged time.

Another object of the invention is to supply ink in a manner which permits labels to be imprinted with characters for a POS system.

Yet another object of the invention is to enable inking and subsequent printing to be performed rapidly.

Yet another object of the present invention is to provide an ink supply device of the above type, in which the force required in the gripping of the hand lever is so reduced that the label printing and applying operations may be accomplished with ease.

A still further object of the invention is to reduce operator fatigue in using a labeling machine supplied with an ink supply device of the above type.

Another object of the present invention is to provide an ink supply device of the above type, which can reduce the manual force required for the gripping action of an actuating hand lever.

In the present invention, the ink supply device is used in a portable label printing and applying machine which has a platen press printing process. The ink supply device uses at least one ink impregnated roller which is guided by predeterminately positionable guide means to roll over the printing surface of a printing head so that the roller contacting with the printing surface may follow a continuously predictable path and be depressed a predetermined suitable depth by the printing surface.

In all embodiments of the present invention, the ink supply device comprises a support that is supported by the machine frame and that is normally biased toward the printing surface. An inking roller is rotatably carried on the support. In some embodiments, the support for the inking roller is pivotally attached to the machine frame. In others, it is pivotally attached to the actuating lever for the entire labeling machine.

In all of the embodiments, a guide roller is rotatably attached at the end of at least one of the inking rollers or to the support for the rollers. Guide means, such as a guide rail or slot, are formed on the machine frame and are engaged by the guide roller. These guide means define the pathway traveled by the inking roller that is controlled by the guide means as it is forced to move. In some embodiments, the inking roller is caused to move along the guide means by the motion of the printing head and its support. In other embodiments, appropriate levers attached to the inking roller and to the actuating lever cause motion of the actuating lever to move the inking rollers along the guide means.

In some embodiments, a bearing plate is attached to the end of an inking roller. The plate is engageable with the lower end surface of the frame of the printing head or the support for that frame. In all embodiments having a bearing plate, the bearing plate at the inking roller defines the distance from any point on the printing head that the inking roller will have. This, in turn, determines how deeply the types being inked will indent into the inking roller. The guide means regulate at least the farthest position of the inking roller relative to the faces of the types, i.e. the printing surface. The inking roller is thus caused to roll over the printing surface under a predetermined pressure.

In an embodiment in which the print head shifts, when the printing head is shifted toward the imprinting position, the bearing plate is pushed by the lower end surface of the printing head or the support therefor against the biasing force that is applied to the inking roller and its support. In this case, the guide means is so oriented with respect to the lower end surface of the printing head or the support for the printing head, e.g. by their meeting at an acute angle, that the force of the printing head toward the imprinting position and against the bearing plate translates into motion of the inking roller across the printing surface.

In other embodiments, the printing head and the support therefor are stationary. Here, the bearing plate is not pushed by the printing heads, but the inking roller is instead moved by levers connected with the actuating lever of the labeler.

In another embodiment of the present invention, the inking roller support comprises a rocker arm. The rocker arm has a cam follower surface near an end thereof. The actuating lever for the labeling machine is attached to a yoke which moves as the actuating lever is operated. A cam on the yoke is positioned to engage the cam follower surface on the rocker arm as the yoke is moved by the actuating lever. Thus, motion of the actuating lever is translated into motion of the rocker arm which moves the inking roller.

In some other embodiments, the ink supply device includes a main inking roller, roller carrying means carrying the main inking roller, and an auxiliary inking roller and auxiliary roller carrying means carrying the auxiliary inking roller. Drive means is pivotally connected to the actuating lever and to both roller carrying means for transmitting the drive force from the former to the latter so that the rollers may be kept in a first position in the vicinity of the printing surface of the printing head as the actuating lever is manually operated. In different embodiments, the two roller carrying means may be separate, independently movable elements or they may be part of a unitary structure.

In one of these other embodiments, position regulating means for the main roller includes guide means of the type described above for other embodiments. Where the guide means comprise guide grooves, the width of the guide grooves is chosen to regulate the spacing during inking operation between the printing surface and the axis of the main inking roller so that the surface of the main inking roller may be depressed a predetermined depth by the printing surface. Auxiliary roller position regulating means includes a bearing plate of the type described for other embodiments which is engageable with the printing surfaces or the frames or supports therefor and which thereby regulates the spacing during inking between the printing surface and the axis of the auxiliary inking roller so that the surface of the auxiliary inking roller may be depressed a predetermined depth by the printing surface.

In another of these embodiments, constant pressure biasing means is connected to the main inking roller for biasing the same onto the printing surface under a predetermined pressure. The constant pressure biasing means includes a push cam spring biased to push against the shaft of the main inking roller. Guide means more of the type previously described are mounted at the auxiliary inking roller for regulating the pressure this roller applies to the printing surface.

Because the auxiliary inking roller rolls over the same printing surfaces as and follows the main inking roller, the ink layer is applied to the printing surfaces in a more precise manner.

In yet another embodiment, the inking roller is moved by means of linkages pivotally connected to the actuating lever, but the spacing and position of the inking roller with respect to the types being inked is determined, on the one hand, by the guide means associated with the inking roller and the machine and, on the other hand, by the bearing plates on the roller and engageable with the printing heads and/or the supports therefor.

Other objects and advantages of the present invention will become apparent from the following description taken in conjunction with the accompanying drawings.

DETAILED DESCRIPTION OF AN EMBODIMENT OF THE PRIOR ART

Figure 13:
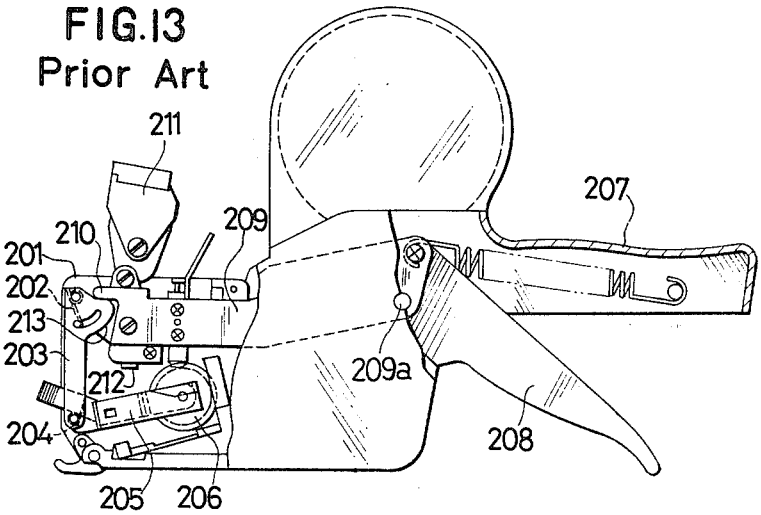
FIG.13 Prior Art
FIG. 13 is a partially cross-sectioned, side elevational view showing a prior art ink supply device.

One embodiment of prior art ink supply is now described, with reference to FIG. 13. Two swingable arms 203 are pivotally connected at their upper ends to a frame 201 of a portable label printing and applying machine. The arms 203 are biased to rotate counterclockwise in FIG. 13 by the action of a spring 202. A holder frame 205 is pivotally connected to the lower free ends of the swinging arms 203. Frame 205 is biased to rotate counterclockwise in FIG. 13 by the action of spring 204. A single inking roller 206 is rotatably attached to a trailing or rear end portion of the holder frame 205.

When hand lever 208 is gripped toward grip 207 of the labeling machine, two yokes 209 are rotated counterclockwise about their pivots 209*a* on the frame of the labeling machine. The projections or cams 210 formed at the leading ends of the yokes 209 push downwardly upon the cam follower surfaces 213, which are formed near the top of the swinging arms 203. As a result, the swinging arms 203 pivot clockwise and this accordingly moves the holder frame 205 to the left. The ink roller 206 is drawn to roll across the printing surface 212 of a printing head 211 so that a suitable amount of ink may be applied to the printing surface 212.

The above described inking device has several characteristics which the present invention improves upon:

(1) The inking roller 206 is pressed against the printing surface 212 by the biasing forces of the two springs 202 and 204. The pressure exerted by the inking roller 206 against the printing surface 212 reduces as the biasing forces of the springs weaken due to aging. This will interfere with the application of ink and will diminish the quality and precision of the printing of a label. For example, label imprints will be dim or have skipped, unmarked areas. Printing quality deterioration is highly undesirable, especially in a labeling machine that prints precisely defined size and shape indicia, such as bar codes, or that prints characters for an OCR (Optical Character Recognition) system or that prints characters for a reader which employs a laser beam, or the like, for the optical reading purpose and which requires high printing precision.

(2) As the biasing forces of the springs reduce, the body of the print head 211 will scarcely be pressed against and into the ink roller 206, thus stopping the pumping of ink from the roller. As a result, ink that is deep inside the ink roller 206 will not be pumped to the roller surface, but that ink will be confined to the center portion of the roller. Were there adequate pumping, it would be possible to use the small quantity of ink that comes to the surface of the roller even with only slight pressure of the printing surface 212 onto the ink roller 206. An ink supply mechanism that is operated by an aging spring cannot provide economical inking because it only permits a small number of impressions for each ink impregnation of the ink roller 206.

(3) When the hand lever 208 is abruptly gripped to its full stroke, ink roller 206 often has no contact or little contact with the printing surface 212, thus making it impossible to obtain a clear imprint on the label then being printed.

(4) Recently, it has become customary to imprint labels with the name of a store, the name, quantity, content and production date of a commodity and, as before, the price of the commodity. In this case, a printing head having a single row of type is not sufficient. The printing head must have two or three rows of printable types. With a printing head having two or more printing forms, ink cannot be applied uniformly by the disclosed conventional method, in which the ink roller 206 is forced by springs into pressure contact with the printing surfaces 212. Irregular ink application will result in correspondingly irregular printing of the label surface. This will, in turn, produce frequent mistakes in the recognition or reading of printed characters or symbols.

DETAILED DESCRIPTION OF PREFERRED EMBODIMENTS OF THE INVENTION

The ink supply device according to the present invention is incorporated in a label printing and applying machine, of the type described in application Ser. No. 681,251, filed Apr. 28, 1976, incorporated by reference.

Figure 1:
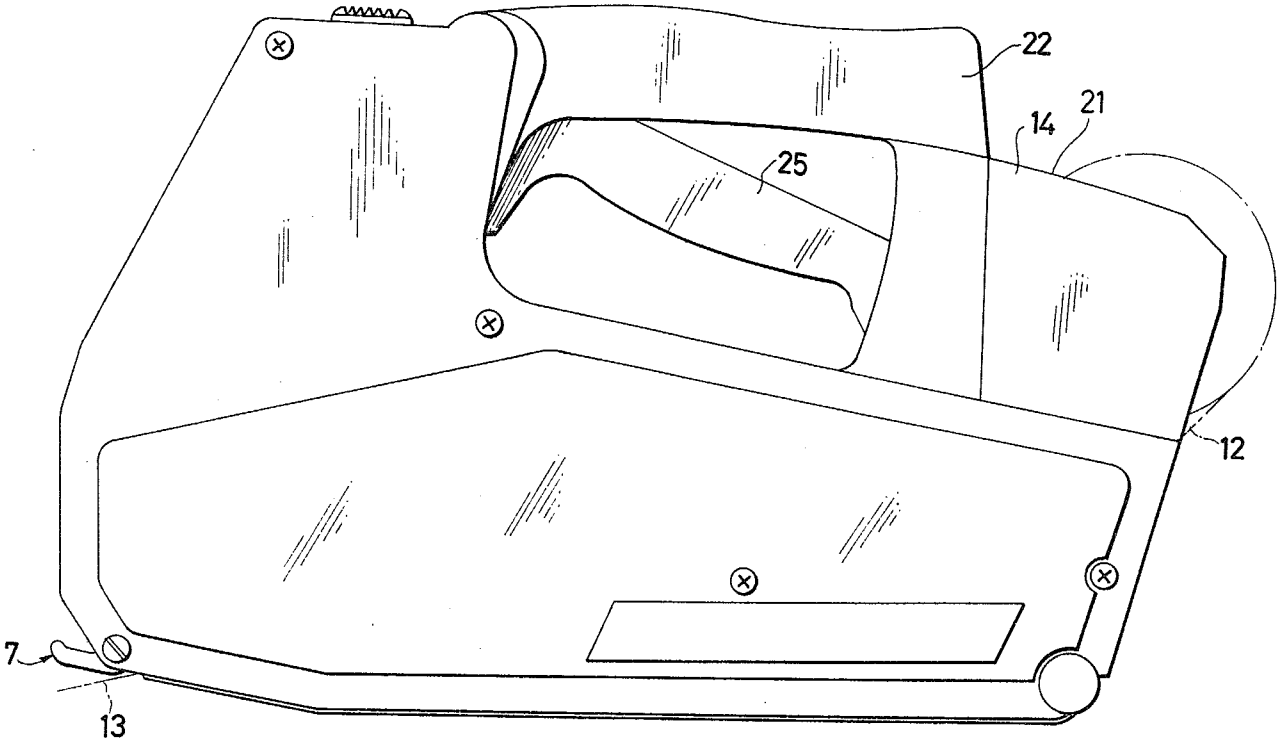
FIG. 1 is a side elevational view of a labeling machine in which a first embodiment of an ink supply device of the invention is incorporated.
Figure 2:
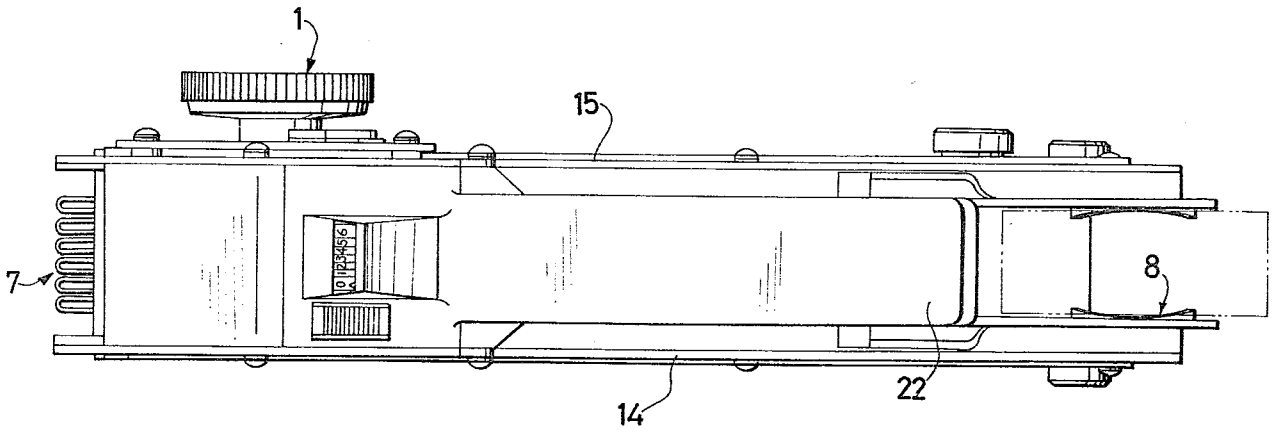
FIG. 2 is a top plan view of the labeling machine of FIG. 1.
Figure 3:
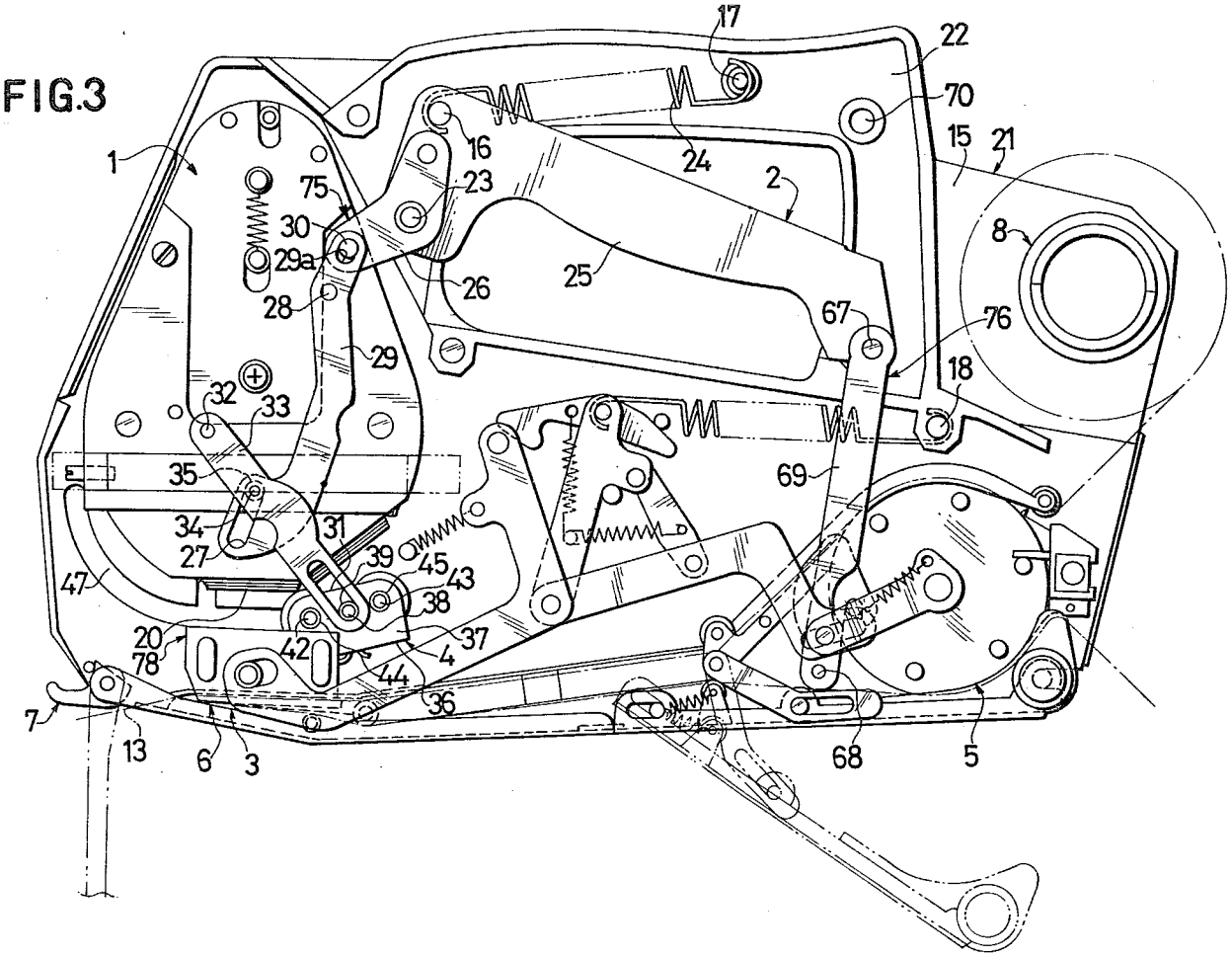
FIG. 3 is a side elevation view into the labeling machine of FIG. 1, showing the first embodiment of the ink supply device.

A first embodiment of ink supply device of the present invention is now described. As shown in FIGS. 1–3, the frame 21 of the label printing and applying machine is comprised of two side plates 14 and 15 which are secured to each other at their upper portions by means of a grip 22 and at their front, center, rear and lower portions by means of a number of shafts and pins, not all of which are illustrated or specified.

The labeling machine includes a conventional printing mechanism 1 which is secured to the upper front portion of the machine frame 21, a drive mechanism 2 mounted to an upper portion of the frame through the grip 22, a hand lever 25, and an ink supply device 4 according to the present invention. The ink supply devide 4 is mounted to a lower front portion of the labeling machine. There are a label strip feed mechanism 5 mounted to a rear portion of the labeling machine, a pressure applying mechanism 3 mounted to a center portion of the labeling machine frame, a label peeling mechanism 6 mounted to the lower front portion of the machine frame for peeling labels from their supporting backing strip, a label applying mechanism 7 mounted to the lower front end of the labeling machine frame, and a label strip holding mechanism 8 mounted to an upper rear portion of the frame and from which the label strip is unwound and fed. Further details as to these features may be found in the above mentioned application Ser. No. 681,251, filed Apr. 28, 1976.

Figure 12:
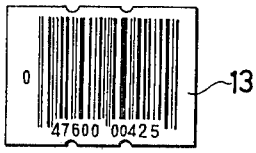
FIG. 12 is a top plan view showing two examples of labels on which bar codes and the corresponding numbers are printed.
Figure 12:
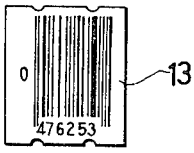

The printing mechanism 1 includes at least one and more usually several rows of types. Each type row is defined by a side by side array of type wheels, each carrying bar codes. Each type wheel is independently rotatable. Each row of type wheels is interposed between two support plates. Each type wheel has a printing surface defined at its lowermost end. The types 20 on each type wheel carry a bar code. The types in one row thereof are arranged side by side. For further detail as to print head constructions useful for all embodiments of the invention, see applications Ser. No. 658,491 filed Feb. 17, 1976 and Ser. No. 678,761, filed Apr. 21, 1976. After each printing operation, a label 13 is printed with a pattern of bar codes of the kind seen in FIG. 12.

Referring to FIG. 3, the drive mechanism 2 is comprised of two front drive levers 29 and two rear drive levers 69, plus the grip 22 and the hand lever 25. The grip 22 in integrally formed at the upper central portion of the machine frame 21. The hand lever 25 is pivotally supported on a pivot 23 on the frame 21, so that the hand lever may be manually gripped toward the grip 22. A drive spring 24 is connected under tension between pin 16 on hand lever 25 and pin 17 on the frame 21, thereby to bias the hand lever 25 in the clockwise direction in FIG. 3.

In front (to the left0 of the hand lever 25, there is a front drive mechanism 75, which includes bifurcated yokes 26 that are integrally attached to the hand lever 25 and pivot therewith. The yokes 26 carry pins 30. The drive mechanism 75 further includes the front drive levers 29. Each drive lever 29 has a slot 29*a* at its upper portion in which a corresponding pin 30 is slidably fitted, thereby permitting relative longitudinal and rotational motion of yokes 26 and drive levers 29. Drive levers 29 have slots 27 at their lower portions and these slots receive and are pivotally supported on pins 34 of rocking levers 33. Slots 27 permit relative longitudinal and pivotal motion of pins 34. In addition, drive levers 29 are secured to the machine frame 20 at the pins 28 spaced in from the upper portions of the lever 29.

At the rear (to the right) of the hand lever 25, there is a rear drive mechanism 76. That mechanism includes the rear drive levers 69 which carry hook pins 68 at their lower ends. The drive mechanism 76 includes a rear drive pin 67, which pivotally connects the rear drive levers 69 to the rear end of the hand lever 25. There is a stop pin 70 on the frame 21 which determines the upper limit of the stroke of the hand lever 25.

Figure 7:
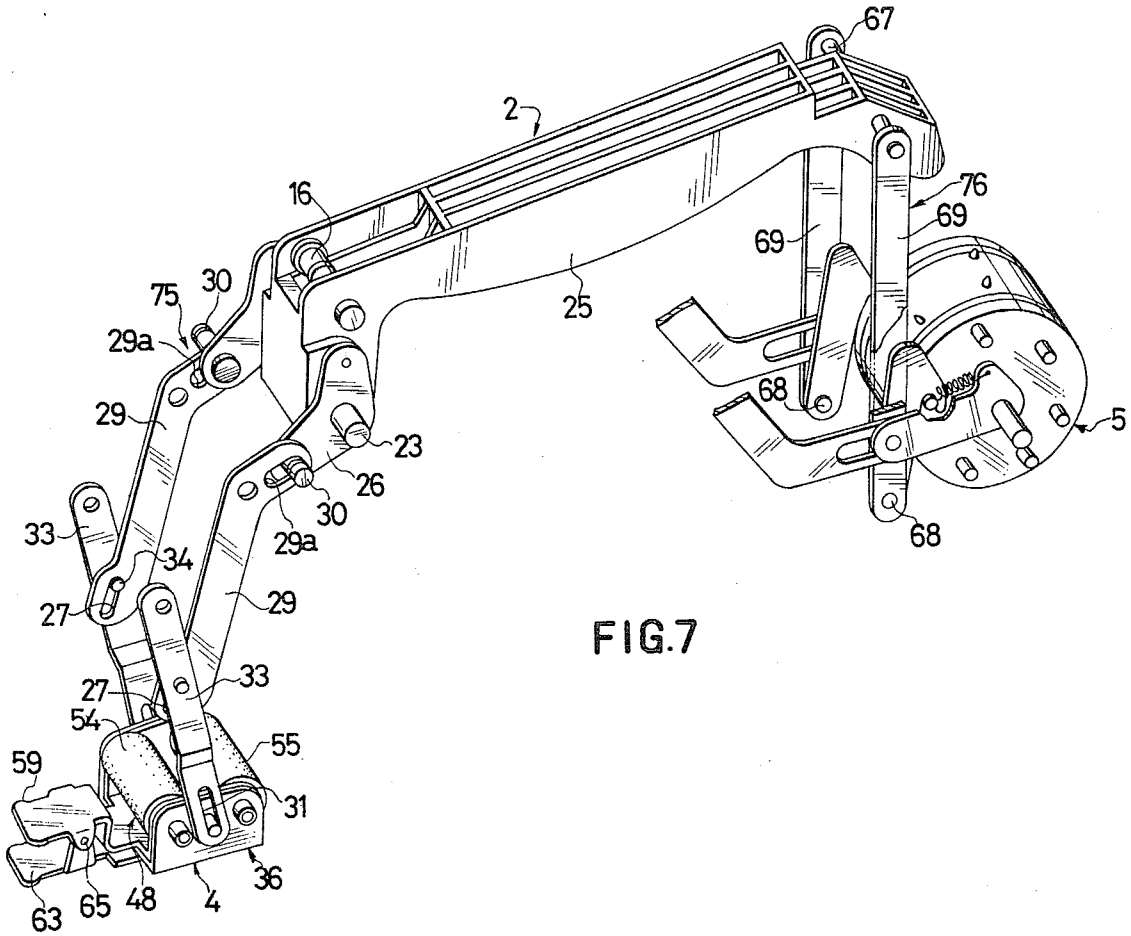
FIG. 7 is a perspective view showing the drive mechanism of the labeling machine, the first embodiment of the ink supply device and a rotating mechanism for a feed roller.

As shown in FIGS. 3 and 7, the ink supply device 4 according to the first embodiment of the present invention is comprised of an ink roller holder 48, a holder frame 36, a pair of rocking levers 33 and also guide means comprised of a pair of curved slots or grooves 47 formed in the side frames 14, 15 and which define the path of motion of frame 36.

Each of the rocking levers 33 has a slot 31 in its lower portion to receive holder frame pin rollers 39 and to permit relative longitudinal and pivotal motion of rollers 39 and frame 36 with respect to rocking levers 33. The upper portion of each rocking lever is pivotally supported by a pin 32, which is affixed in the machine frame 21. The pins 34 extend from the middle portion of the rocking levers 33. Rings 35 are loosely fitted on corresponding rocking lever pins 34. The rings 35 are shaped and fitted to slidably engage in the slots 27 of the front drive levers 29.

Figure 9:
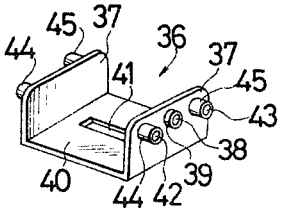
FIG. 9 is a perspective view of an inking roller holder frame.

Turning to FIG. 9, the holder frame 36 has a U-shaped cross-section. The outer sides of its opposed side walls 37 carry outwardly projecting pins 38. Disposed around these pins 38 are loosely fitted rings 39, which are shaped and fitted to slidably engage with the slots 31 of rocking levers 33. The side walls 37 are joined by a bottom plate 40. Plate 40 includes a generally centrally located retaining slot 41 extending across the plate toward side walls 37. Two pairs of guide pins 42 and 43 project from corresponding positions on the outer side of the opposed side walls 37 and in front and in back of the pins 38, respectively. On the guide pins 42 and 43, there are loosely fitted two pairs of corresponding rings 44 and 45, respectively. The rings 44 and 45 are slidably received in the curved guide means slots or grooves 47, which are formed in the side plates 14 and 15. This enables the holder frame 36 to move back and forth in slots 47, as better seen in FIG. 4. The ink roller holder 48 is removably retained on the bottom plate 40 of the holder frame 36, as will be explained below.

Figure 10:
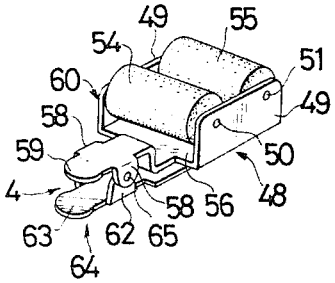
FIG. 10 is a view similar to FIG. 9 and showing an inking roller holder.
Figure 11:
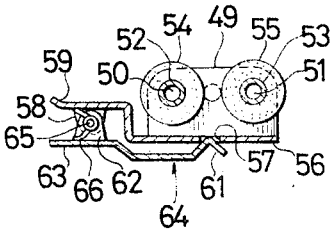
FIG. 11 is a longitudinal cross-sectional view of the inking roller holder of FIG. 10.

As shown in FIGS. 10 and 11, the ink roller holder 48 is comprised of an ink roller frame 60, a retaining member 64 and a pair of ink-impregnated rollers 54 and 55. The ink roller frame 60 has a U-shaped cross-section similar to that of the holder frame 36. The opposed side walls 49 of the frame 60 are secured together by a bottom plate 56, which also has a centrally located retaining slot 57 extending across plate 56 toward walls 49. Two support shafts 50 and 51 are located between the side walls 49 so that they may pivotally support the ink impregnated spongy rollers 54 and 55. The rollers have respective built-in central sleeves 52 and 53. The front (left in FIGS. 10 and 11) extension of the bottom plate 56 of the ink roller frame 60 is of narrowed width and is bent upward so that its leading end forms a tab 59. Depending from both sides of the front extension, just behind the bent portion thereof is a pair of ears 58 which form an inverted "U" with the front extension.

The retaining member 64 for retaining the ink roller holder 48 on the holder frame 36 is bent at its front (left) portion so as to form a tab 63 and it is bent to define a pair of upstanding ears 62 at both sides of the tab 63, rearwardly of its front. Ears 62 are alignable with the ears 58. The rear extension of the retaining member 64 is folded to define a retaining portion 61 having an inverted "V" shape. The ears 58 of the ink roller frame 60 are pivotally attached to the corresponding ears 62 of the retaining member 64 by means of a pin 65. A torsion spring 66 is mounted on pin 65 and engages the elements 59 and 63 to force the retaining portion 61 into the remaining slot 57 in the ink roller holder 48.

When the tabs 59 and 63 of the ink roller frame 60 and the retaining member 64, respectively, are manually pivoted by being pinched toward each other against the action of the spring 66, this separates the bottom plate 56 of the frame 60 and the retaining portion 61. With the retaining portion apart from frame 60, the bottom plate 40 of the holder frame 36 is inserted into the space between the plate 56 and the portion 61 and the openings 41 and 57 are aligned. The tabs 59 and 63 are then released and this forces the retaining portion 61 into engagement with the retaining slot 41, thus securing the ink roller holder 48 in position in the holder frame 36.

Figure 4:
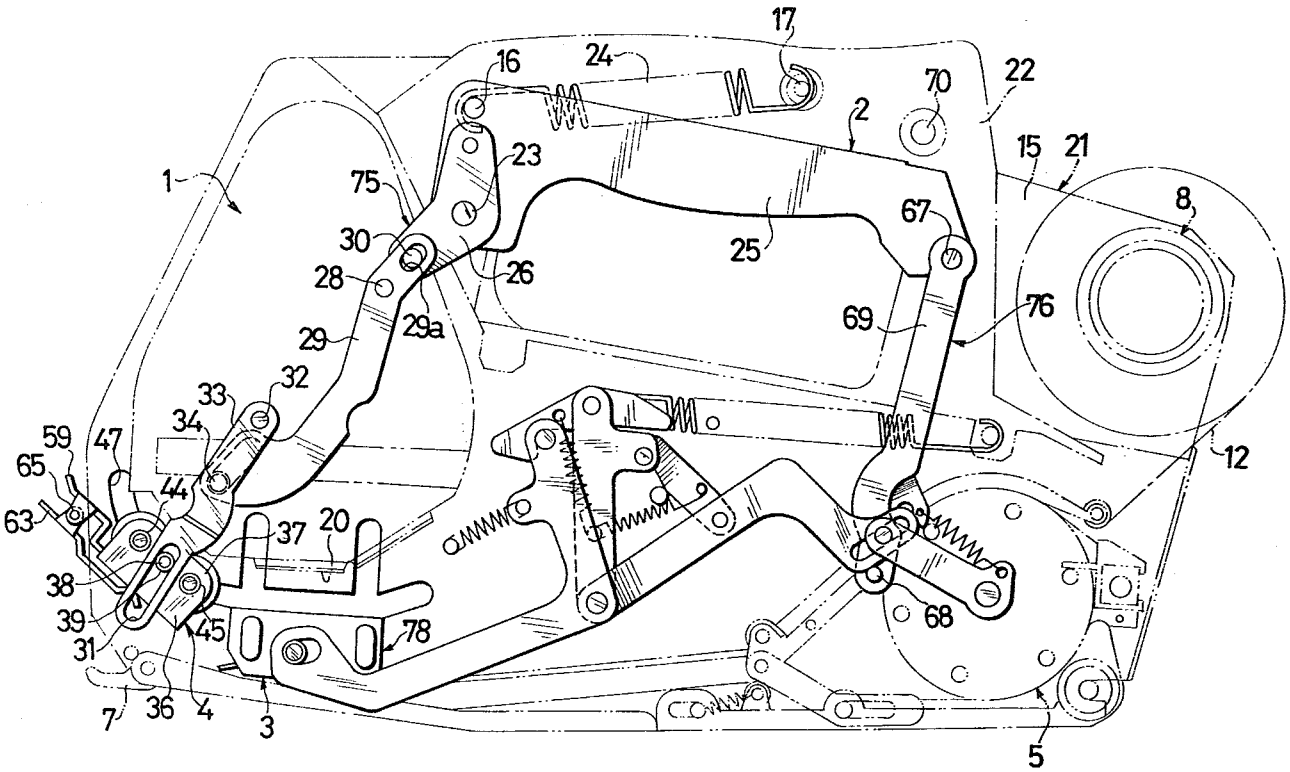
FIG. 4 is a side elevational view of the type shown in FIG. 3, showing the operation of the labeling machine when the hand lever is gripped.

The ink supply device of the first embodiment of the present invention operates as follows. When the hand lever 25 is gripped, the front drive levers 29 connected to the yokes 26 are rotated clockwise about the fixed pins 28, as shown in FIG. 4. The rocking levers 33 are also rotated clockwise about the pins 32. As a result, the holder frame 36 is moved forward through the curved slots or grooves 47. The rings 44 and 45, which are loosely fitted on the guide pins 42 and 43 of the holder frame 36, are slidably guided through the slots or grooves 47. The two spongy, ink impregnated rollers 54 and 55 are rolled over the printing surface 20 and exert a predetermined pressure thereupon. The spongy rollers 54, 55 rotate as their outer peripheral surfaces are pressed against, depressed by and rolled past the printing surface 20. Thus, the ink, which is stored at the center of the ink-impregnated rollers 54 and 55 oozes to their peripheries due to the pumping action which occurs when the type caused depressions in the rollers bulge to restore their original contour. Furthermore, because two or more inking rollers (54 and 55 in this embodiment) turn past the same printing surface 20, ink can be supplied to the printing surface 20 in a sufficient quantity and uniformly.

Figure 5:
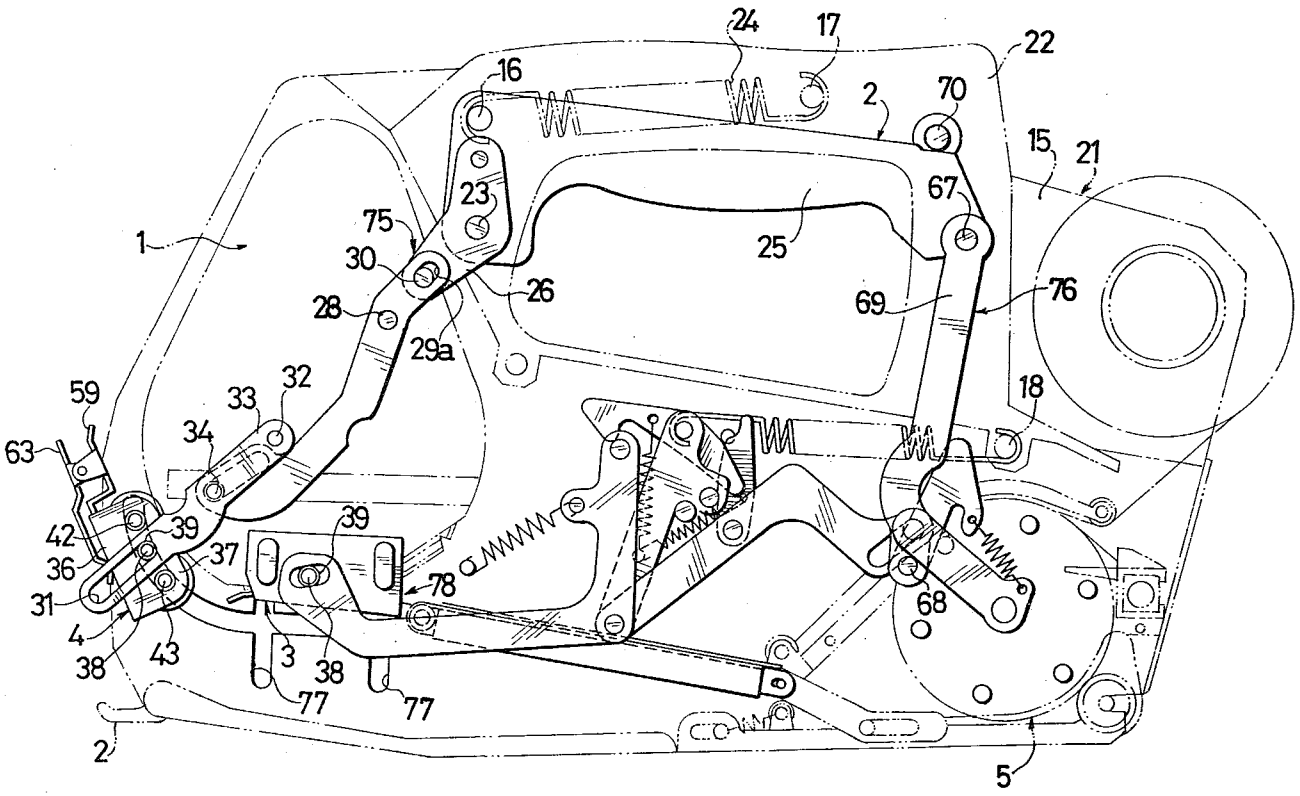
FIG. 5 is a view similar to FIG. 4, showing the labeling machine with the hand lever further gripped and the platen pressed against the printing surface.
Figure 6:
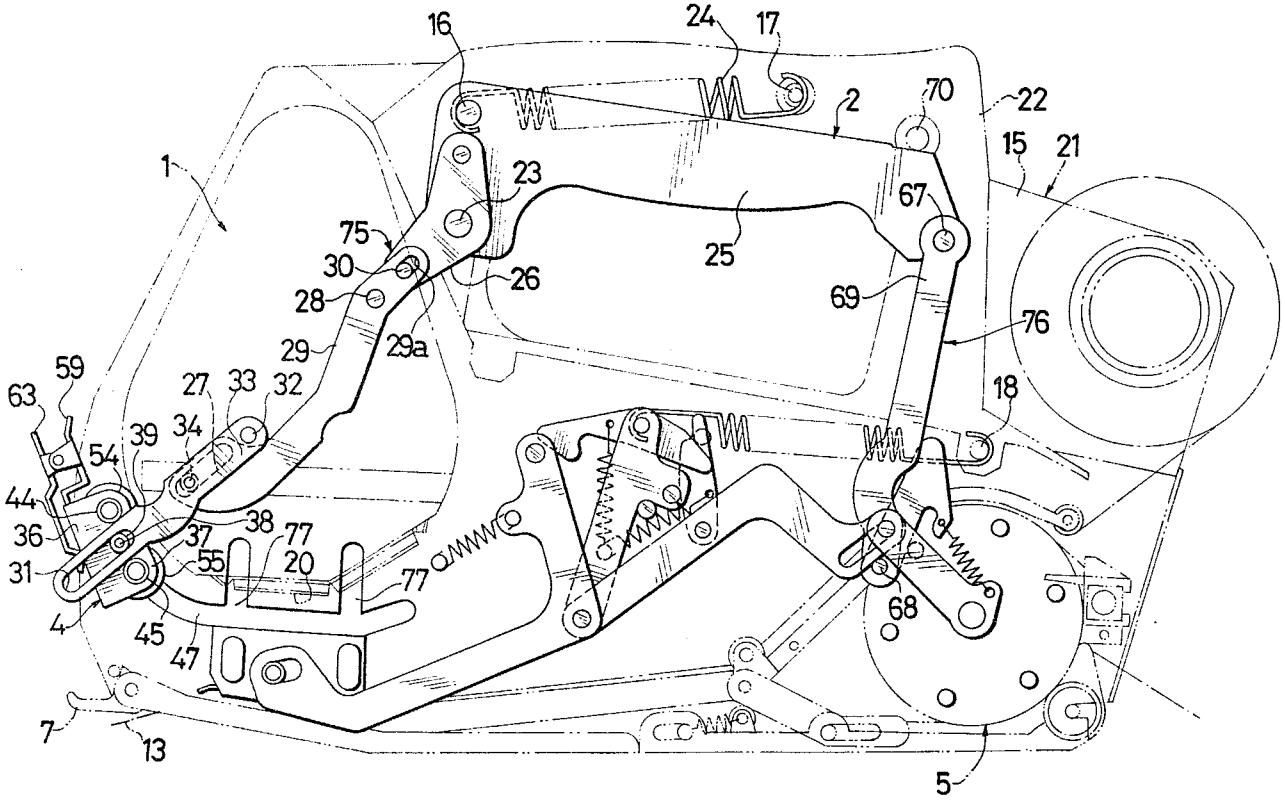
FIG. 6 is also a view similar to FIG. 4, showing the labeling machine with the hand lever gripped to its full stroke and with the platen lowered.
Figure 8:
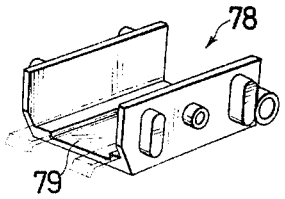
FIG. 8 is a perspective view of a platen for the labeling machine.

Printing by the printing means is carried out while the holder frame 36 and the ink roller holder 48 are at their front rest positions and after each application of ink to the printing surface 20. The pressure keeping mechanism 3 which enables printing on a label, includes a platen 78 having a pressing surface 79, as shown in FIG. 8. The platen 78 is rapidly elevated and lowered along vertical grooves 77 (compare FIGS. 4 and 5), while the holder frame 36 is in its rest position. This presses a label 13 that is then on the pressing surface 79 against the printing surface 20. With consecutive feeding of the labels, printing of the labels 13 in sequence occurs, as seen from FIGS. 12 and 13.

When the hand lever 25 is released from its gripped condition, the holder frame 36 is forced to return (to the right) by the action of the drive spring 24, to the ink supply position of FIG. 3.

The ink-impregnated rollers 54 and 55 are pressed against and roll over the printing surface 20 under a constant predetermined suitable pressure. As a result, the quantity of ink supplied to the printing surface can be maintained at a constant level. This enables precision printing of labels. Since the ink at the surfaces of the rollers and also the ink which is near the center portion of the rollers, can be pumped out and used with little loss, a greater number of labels can be printed by inking rollers after a single ink impregnation of the rollers with conventional ink supply device. In addition, the inking rollers can be simply interchanged.

Figure 14:
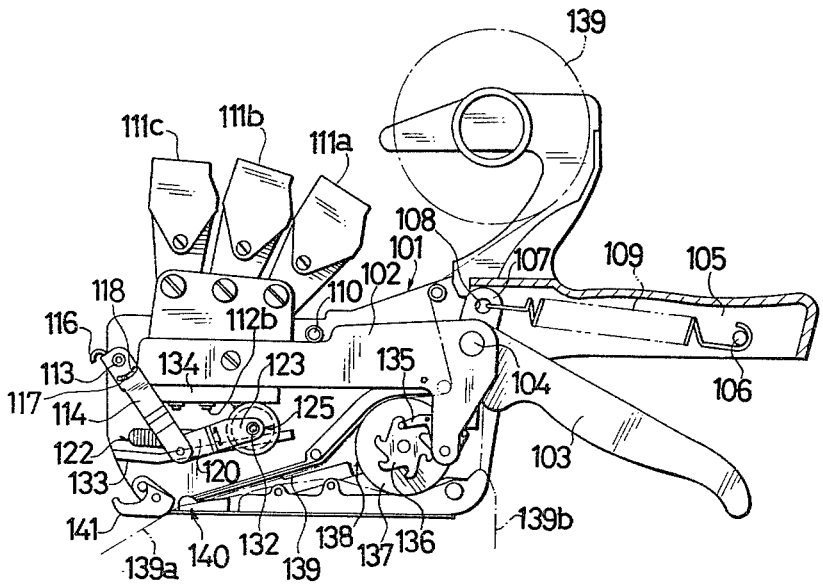
FIG. 14 is a partially cross-sectioned, side elevational view of a portable labeling machine containing an inking device according to a second embodiment of the present invention, with the frame plate of the machine removed.
Figure 15:
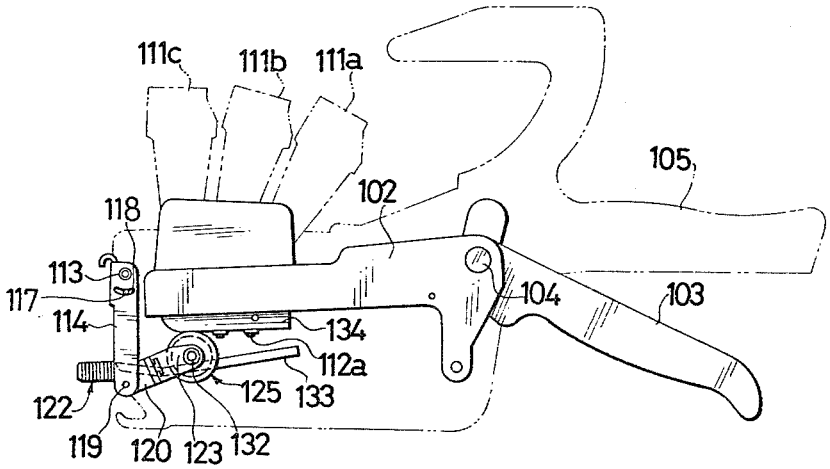
FIG. 15 shows a detail of the labeling machine of FIG. 14, in which the hand lever has been moved partially through its full stroke.
Figure 16:
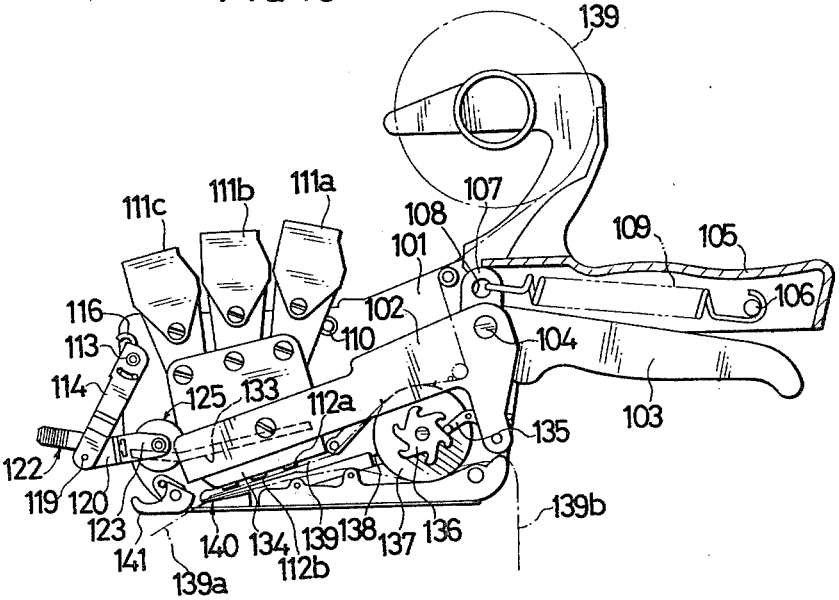
FIG. 16 is cross-sectional, side elevational view of the same labeling machine in which the hand lever has been moved through its full stroke.

The second embodiment of inking device of the present invention is now described. Referring to FIGS. 14 to 16, there is a machine frame 101 containing a pair of yokes 102. The yokes 102 are secured to each other near the top rear (right hand) portion. The yokes 102 are integrally joined with the front end portion of a hand grip lever 103. The yokes are also pivotally attached to the machine frame 101 at a fixedly located support shaft 104.

Immovable grip 105 extends rearwardly from the machine frame 101. A spring pin 106 is affixed in the grip 105. Spring supporting projection 107 is integrally attached to the hand lever 103. A spring 109 under tension extends between a hole 108 formed in the projection 107 and the spring pin 106. This normally biases the yokes 102 and the hand lever 103 clockwise about the support shaft 104.

The stopper 110 on frame 101 engages the upper sides of the yokes 102 and this determines the upper limit of spring biased motion of the yokes 102.

Referring to FIG. 14, the ratchet pawl 135 is attached to a rear portion of the yokes 102 and is spaced from yoke pivot 104. A ratchet wheel 136 is mounted to rotate about a shaft that is fixedly located on frame 101. The pawl 135 and wheel 136 are positioned so that pawl 135 engages ratchet wheel 136 to rotationally advance the ratchet wheel 136 by a predetermined angle during each cycle of motion of yokes 102 under the influence of hand lever 103.

A feed wheel 137 is fixed coaxially to the ratchet wheel 136. Feed wheel 137 has a plurality of angularly spaced feed teeth 138 on its outer periphery. These feed teeth are engageable with engagement portions (not shown) of a continuous strip 139 of labels so that the continuous label strip 139 may be fed through the labeling machine by the rotations of the feed wheel 137.

The continuous label strip 139 is a laminate of a series of labels to be printed and applied and of a supporting backing strip. The label strip 139 is separated at a peeling portion 140 into a series of labels **139*a* and into a strip 139*b* of backing paper. The labels 139*a* have adhesive on their back sides so that they can be adhered to a commodity to be labeled by a label applicator 141**. Other features of the construction of the labeling machine can be obtained from aforesaid application Ser. No. 681,251.

Figure 17:
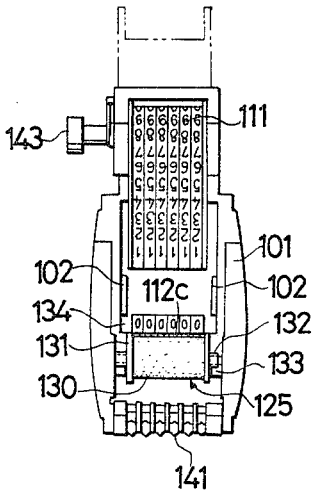
FIG. 17 is a front elevational view of the labeling machine of FIGS. 14–16.

Three printing heads **111*a*, 111*b* and 111*c* are fixedly attached to the leading (left hand) end portions of the yokes 102. The printing heads extend through a printing mechanism frame 134 on the yokes. The desired type on each of the printing heads 111*a*, 111*b* and 111*c* is selected by the respective selecting knob 143 for that head (FIG. 17). A label 139*a*, which is described above, may thus be printed by the selected type 112*a*, 112*b* and 112*c* then at the print position on the respective printing heads 111*a*, 111*b* and 111*c***.

Referring to FIGS. 14–16 and 18, a shaft 113 is fixedly mounted to the machine frame 101. A pair of spaced apart rocker arms 114 are pivotally attached at their upper ends to respective opposite ends of the shaft 113. The rocker arms 114 are normally biased to rock counterclockwise in the drawings by spring 116 which is wound around and engages shaft 113 and the upper web joining arms 114. A pair of pins 117 project inwardly from and are affixed to the machine frame 101. Pins 117 pass through and are guided by corresponding guide grooves 118 in arms 114, in accordance with the rocking motions of the rocker arms 114.

Figure 19:
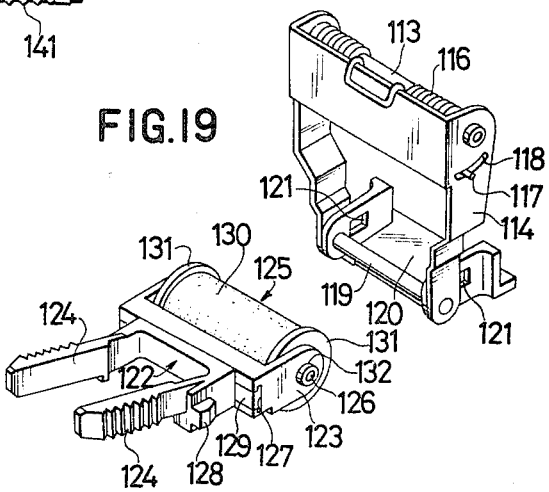
FIG. 19 is a perspective view of the inking device of FIG. 18 under the condition in which a cartridge frame and holder for an inking roller have been removed from a support member.

Referring to FIG. 19, a support member 120 extends between and is pivotally attached by a shaft 19 to the lower end portions of the rocker arms 114. The support member 120 has side plates at arms 114. These are engagement holes 121 through both side plates.

The U-shaped ink roller holder 122 is removably attached to the support member 120. The holder 122 is formed from a flexible, resilient material and is preferably of plastic. Near the centers of the exteriors of both of its side arms, the holder 122 carries side projections 128 which are snapped into the engagement holes 121 of the respective support members 120. Further out along the legs of holder 122 beyond projections 128, there are pinch portions 124. The outer surfaces of the legs defining these pinch portions are notched to eliminate operator's finger slippage. The bottom of the web of the holder 122 supports a "T" cross-section projection 129, which is fitted into a correspondingly shaped engagement groove 127 of an ink roller frame 123, as described below. This provides a tongue-in-groove type connection between ink roller frame 123 and ink roller holder 122.

The ink roller frame 123 is U-shaped. An inking roller 125 is rotatably mounted between the legs of the frame 123 by a shaft 126. At the bottom of its web, the frame 123 has the engagement groove 127 which receives and is shaped to securely retain the projection 129 of the holder 122. The frame 123 may thus be removably attached to the holder 122 to form an integral assembly.

Figure 18:
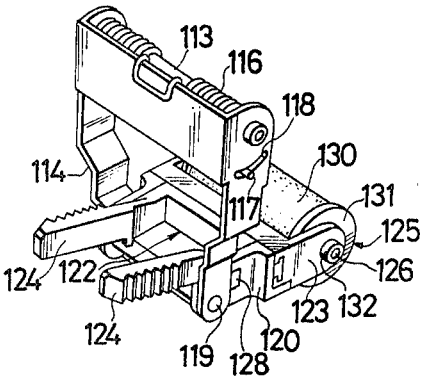
FIG. 18 is a perspective view of the second embodiment of inking device according to the present invention.

In FIG. 18, which shows the assembled ink supply device, the projections 128 of the holder 122 are fitted in the engagement holes 121 of the support member 120. This mounts the cartridge type frame 123 to the support member 120. In this manner, the inking roller 125 is removably attached to the labeling machine.

When the inking roller 125 has been exhausted of its ink, the pinch portions 124 of the holder 122 are squeezed together by an operator. This deforms the legs of the "U"-shaped holder 122 to disengage the projections 128 from the holes 121. As shown in FIG. 19, the cartridge type frame 123 holding the inking roller 125 is removed from the support member 120 together with the holder 122. Then the engaged groove 127 and projection 129 are separated by displacing the frame 123 and the holder 122 sideways of each other.

A new cartridge type frame 123 carrying a replacement inking roller 125 is attached to the holder 122. The pinch portions 124 are again squeezed and the projections 128 are fitted in the holes 121. Then the pinch portions 124 are released and the support member 120 resumes its original shape.

The inking roller 125 is of integral roller construction. The roller is comprised of an ink impregnated spongy body 130 and of a pair of bearing plates 131 attached to both ends of the body 130. This inking roller 125 is rotatably supported between the leg portions of the frame 123 by the shaft 126 passing through the roller. A pair of guide rollers 132 are rotatably attached at the outsides of the side walls of the frame 123 at both ends of the shaft 126. The rollers 132 are freely rotatable with respect to shaft 126.

Referring to FIGS. 14 and 17, there are a pair of narrow width guide rails 133 affixed to the inner walls of the machine frame 101, and extending forwardly and rearwardly in the frame 101. The rails 133 incline slightly downwardly moving forwardly (left in FIG. 14) through the labeling machine. They are also normally vertically spaced from the printing head frames 134. Frames 134 are part of the yokes 102, whereby below described motion of frames 134 is corresponding motion of yokes 102.

The leading end portions of the guide rails 133 are slightly inclined upwardly, for reasons discussed below. The guide rollers 132 roll over the upper sides of the guide rails 133. At the same time, the bearing plates 131 roll under and against the lower sides of the printing head frames 134. The undersides of the frames 134 are so oriented and the rails 133 spaced from the frames 134 are so oriented that they are oblique to each other and a preferably acute angle is defined between their directions of extension, which serves to move the inking device as described below. Also, the spacing between rails 133 and frames 134 is such that the guide rollers 132 may ride atop rails 133 and at least part of the inking roller 125 is between rails 133 and the undersides of frames 134 as the types are inked.

The operation of the ink supply device according to the second embodiment of the present invention is now described. When the hand lever 103 is manually gripped toward the grip 105, the yokes 102 are rotated counterclockwise in FIG. 14 about their support shaft 104. This causes the lower sides of the printing head frames 134, which are fixed to the yokes 102, to push down against the bearing plates 131 at the ends of the inking roller 125. This presses the guide rollers 132 against the guide rails 133. Because the guide rails 133 are inclined with respect to the undersides of frames 134, the guide rollers 132 and the coaxial inking roller 125 are moved forward along the upper sides of the guide rails 133 by the forward component of the pushing force of the printing head frames 134. Forward motion of the inking roller 125 under the guidance of frames 134 and rails 133 moves the spongy roller body 130 across and into contact with the types 112*a*, 112*b* and 112*c* of the respective printing heads 111*a*, 111*b* and 111*c* which are fixed to the printing head frames 134. The types are thereby supplied consecutively with the proper and uniform amount of ink, as shown in FIG. 15.

In addition to the inking roller 125, the frame 123, the support member 120 that supports the inking roller 125 and the holder 122 are all moved forward through the machine frame 101. The rocker arms 114, which are pivoted to the support member 120, are turned clockwise about the shaft 113 until they assume their substantially vertical positions (compare FIGS. 14 and 15).

Because the bearing plates 131 of the inking roller 125 rotate against the lower sides of the printing head frames 134, this regulates the closest position of the inking roller 125, 130 relative to the printing surfaces 112*a*, 112*b* and 112*c*. As the diameters of the bearing plates 131 increase, the inking roller 125 will be spaced further from every point on the print head. As a result, the ink-impregnated roller body 130 can be protected against being too strongly pushed and deeply deformed by the printing surfaces 112*a*, 112*b* and 112*c*, thereby to preclude overinking. The guide rollers 132 riding upon the guide rails 133 regulate the farthest distance of the inking roller 125 relative to the printing surfaces 112*a*, 112*b* and 112*c*, so that these printing surfaces can be pressed by the inking roller with a predetermined and uniform pressure.

Figure 20:
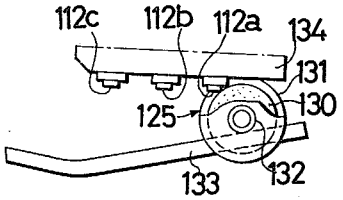
FIGS. 20*a*, 20*b* and 20*c* are fragmentary side elevational views showing stages in the operation of the second embodiment of the inking device.
Figure 20:
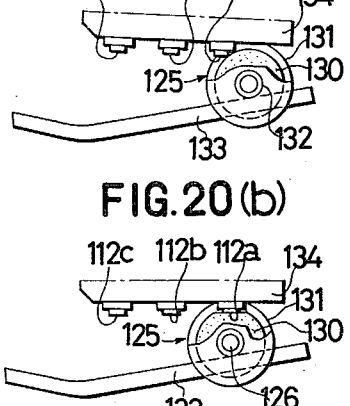
Figure 20:
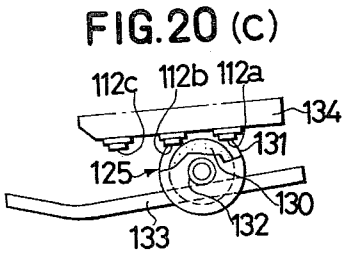

Turning to FIGS. 20*a*, 20*b* and 20*c*, the ink impregnated spongy roller body 130 is depressed in sequence by the printing surfaces 112*a*, 112*b* and 112*c*. Ink stored in the center portion of the roller body 130 is pumped to the surface of the roller when the depressions in the roller return to their original shapes. This arrangement has the advantages that a proper amount of ink can be supplied to the printing surfaces 112*a*, 112*b* and 112*c*, which enables a clear print to always be obtained and that substantially all of the ink in the inking roller can be used without any waste, whereby the ink supply device of the present invention is highly economical.

When the hand lever 103 is further gripped to its full stroke, the bearing plates 131 of the inking roller 125 are moved forward beyond the lower sides of the printing head frames 134. The bearing plates 131, inking roller 125 and rollers 126 then ride on the upwardly inclined forward portion of rails 133 which raise the rollers 132, as shown in FIG. 16. Once the bearing plates are no longer pressed by frames 134, they stop just forward of the frames 134 and spring 116 presses the bearing plates lightly against the front of frames 134. Once the inking roller is forward of frames 134, the printing heads 111*a*, 111*b* and 111*c* are lowered to bring their respective printing surfaces 112*a*, 112*b* and 112*c* into engagement with the upper sides of the continuous label strip 139 and this prints the label 139*a* then beneath surfaces 112.

When the hand lever 103 is released from its gripped condition, the yokes 102 and frames 134 are returned clockwise by the spring 109. The inking roller 125, which has been halted in engagement with the front face of the printing head frames 134, is returned rearwardly along the upper sides of the guide rails 133 by the spring 116, which is biasing the rocker arms 114 to the original position of FIG. 14. The ratchet pawl 135 on the yokes 102 simultaneously moves a predetermined distance (to the left in FIG. 14) with the rocking motion of the yokes and the pawl rotates the ratchet wheel 136 through a predetermined angle. The feed wheel 137 is turned through the same angle. This feeds the continuous label strip 139, which is in engagement with the feed teeth 138. At the peeling portion, the continuous label strip 139 is separated to remove the labels 139*a*, which have already had their upper sides imprinted with desired indicia. The imprinted labels 139*a* are fed to an area below the label applicator 141.

Figure 21:
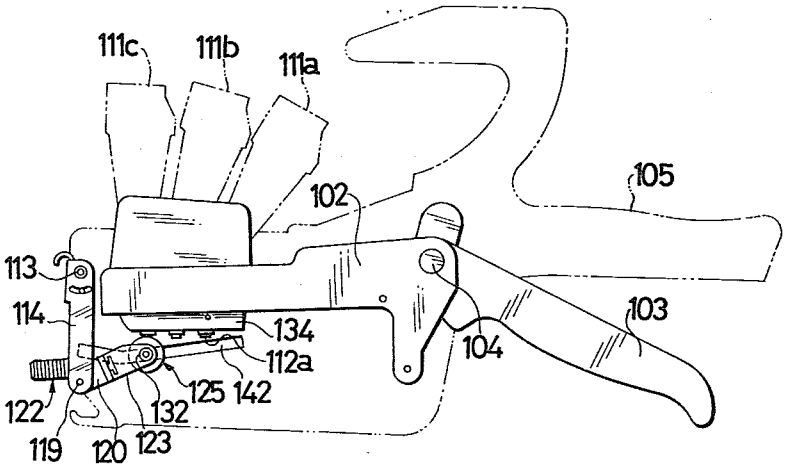
FIG. 21 is a view similar to FIG. 15 and showing a third embodiment of ink supply device according to the present invention.
Figure 22:
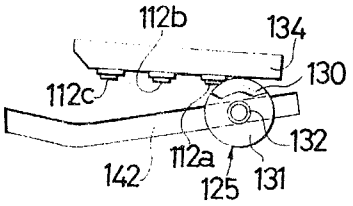
FIGS. 22*a*, 22*b* and 22*c* are fragmentary side elevational views showing stages in the operation of the third embodiment of the inking device.
Figure 22:
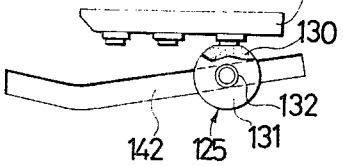
Figure 22:
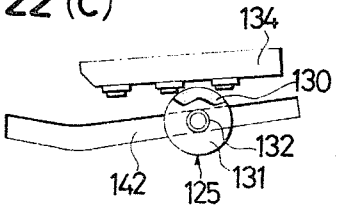

FIGS. 21 and 22 show the third embodiment of the present invention, wherein a pair of guide slots 142 in the inside walls of the side frames serve as the guide means in place of the guide rails 133 of the second embodiment. In all other respects, the third embodiment corresponds to the second embodiment. The description of the common features of the third embodiment is not repeated. Common features of the second and third embodiments are numbered identically. The guide slots 142 have substantially the same breadth as the outer diameters of the guide rollers 132. The guide rollers 132 can turn in the guide slots 142. Like the guide rails 133, the guide slots 142 are inclined downwardly in the forward direction, as compared with the lower sides of the print head frames 134. The leading end portions of slots 142 are slightly inclined upward. In this embodiment, because the inking roller 125 has its position with respect to the printing heads 111*a*, 111*b* and 111*c* regulated by the action of the guide slots 142, the bearing plates 131 may have substantially the same diameter as the roller body 130. This is also because the bearing plates 131 need not turn upon the lower sides of the printing head frames 134, as contrasted with the second embodiment where they must roll over these lower sides.

The operation of the third embodiment is similar to that of the second embodiment. Upon squeezing hand lever 103, the lower surfaces of the printing head frames 134 push the bearing plates 131 sideways and the guide rollers 132 are turned in the guide slots 142 by the sideways (leftward in FIG. 21) component of the pushing force. The spongy roller body 130 is turned consecutively over the printing surfaces 112*a*, 112*b* and 112*c* and supplies them with the proper amount of ink. See the sequence shown in FIGS. 22*a*, 22*b* and 22*c*. With the regulating action provided by the guide slots 142, the roller body 130 pushes the printing surfaces with a predetermined proper pressure and supplies a proper amount of ink.

The ink impregnated body of the inking roller is always forced to roll over the printing surface under a regulated constant pressure. Therefore, the amount of ink supplied to the printing surface can be constant. Highly precise printing of the labels can be obtained. Ink stored both on the surface and at the center portion of the inking roller can be used to the last. Thus, a greater number of labels can be printed by a single inking roller than with a conventional method.

The fourth embodiment of the present invention is now described. The labeling machine and the inking device therein of the fourth embodiment are virtually identical in structure and operation to the second embodiment. These descriptions are, therefore, not repeated. Only the different elements of the fourth embodiment are described. Each element of the fourth embodiment that corresponds to one in the second embodiment is correspondingly numbered with a reference numeral raised by 200.

Instead of having the generally straight sided configuration of the second embodiment, the rocker arms 314 have rearwardly projecting cam followers 315 formed at their upper sides. The upper surfaces 315*a* of the cam followers 315 are the cam follower surfaces, and these surfaces incline both downwardly and rearwardly to facilitate rolling cooperation with below described roller cams 342.

At the forward end of the yokes 302, remote from their pivot 304 and above the cam follower surfaces 315*a* are positioned freely rotating camming rollers 342, which ride down the cam follower surfaces 315*a* as the yokes 302 pivot. The cam followers 315*a* and cams 342 cooperate in pivoting the rocker arms 314, as described below.

Figure 23:
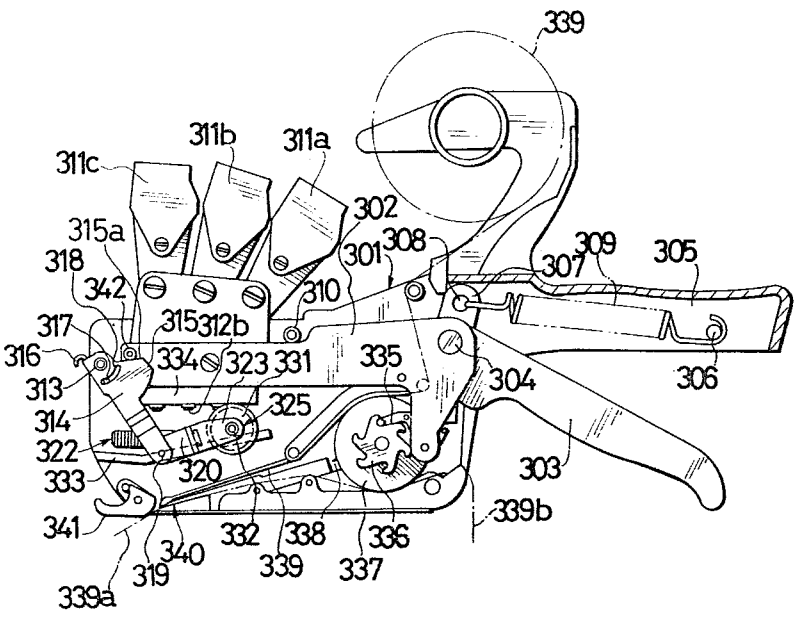
FIG. 23 is a partially cross-sectioned, side elevational view of a portable labeling machine containing a fourth embodiment of inking device according to the invention with the frame plate of the labeling machine removed.
Figure 24:
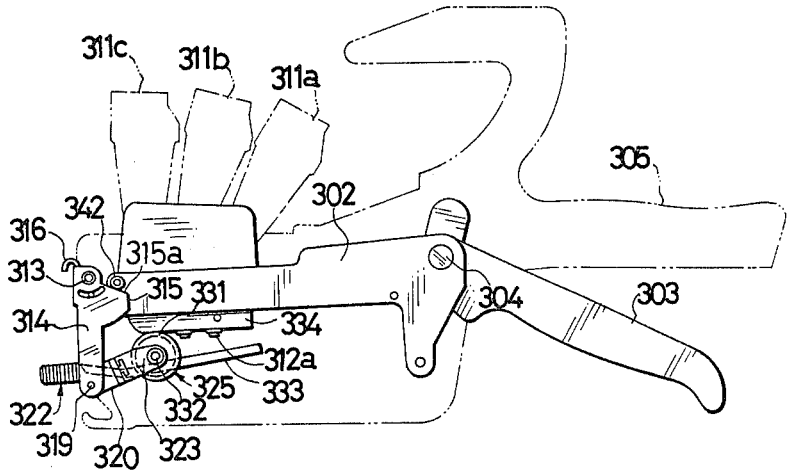
FIG. 24 shows a detail of the labeling machine of FIG. 23, in which the hand lever has been moved partially through its stroke.

The operation of the ink supply device according to the fourth embodiment of the present invention is now described. When the hand lever 303 is manually gripped toward the grip 305, the yokes 302 are rotated counterclockwise in FIG. 23 about the support shaft 304. Compare FIGS. 23 and 24. The camming rollers 342 mounted on the leading ends of the yokes 302 push down the cam followers 315*a* of the rocking arms 314. The arms 314 turn clockwise against the normal bias of the spring 316. Thus, the support member 320, which is pivoted to the rocking arms 314, and also the holder 322, the frame 323 and the inking roller 325 are together moved forward (left in the drawings). The guide rollers 332 roll over the guide rails 333 while the bearing plates 331 roll upon the lower sides of the printing head frames 334. Forward motion of the inking roller 325 under the guidance of frames 334 and rails 333 moves the spongy roller body 330 across and into contact with the types 312*a*, 312*b* and 312*c* of the respective printing heads 311*a*, 311*b* and 311*c*, which are fixed to the printing head frames 334. The types are thereby supplied consecutively with the proper and uniform amount of ink. Because the bearing plates 331 of the inking roller 325 rotate against the lower end surfaces of the printing head frames 334, this regulates the closest position of the inking roller 325, 330 relative to the printing surface 312*a*, 312*b* and 312*c*. The guide rollers 332 riding upon the guide rails 333 regulate the farthest distance of the inking roller 325 relative to the printing surfaces 312*a*, 312*b* and 312*c*.

Turning to FIGS. 32–38, the ink impregnated spongy roller body 330 is depressed in sequence, by the printing surfaces 312*a*, 312*b* and 312*c*. This operates upon the inking roller 330 in the same manner as in the second embodiment and results in the same advantages.

Figure 25:
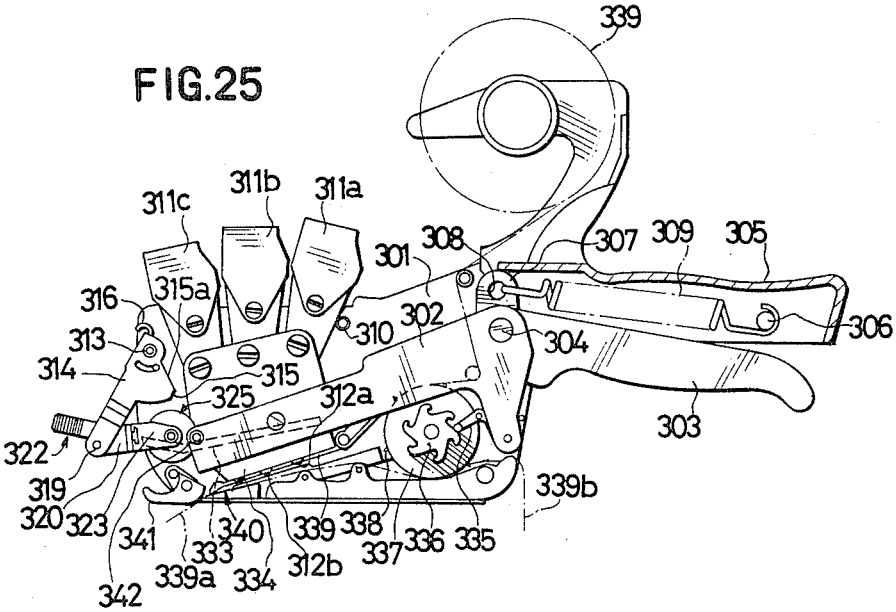
FIG. 25 is a cross-sectional, side elevational view of the same labeling machine in which the hand lever has been moved through its full stroke.
Figure 26:
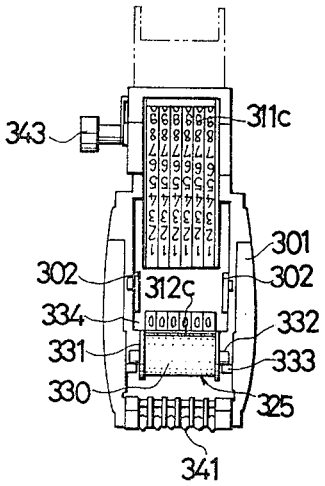
FIG. 26 is a front elevational view of the labeling machine of FIGS. 23–25.
Figure 27:
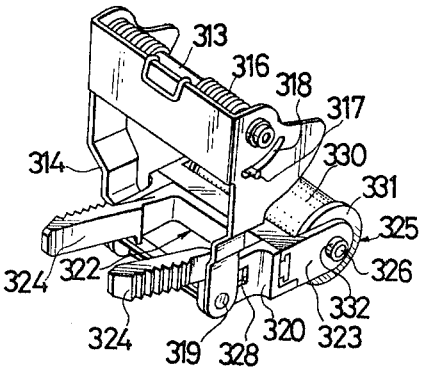
FIG. 27 is a perspective view of the fourth embodiment of the inking device according to the present invention.
Figure 28:
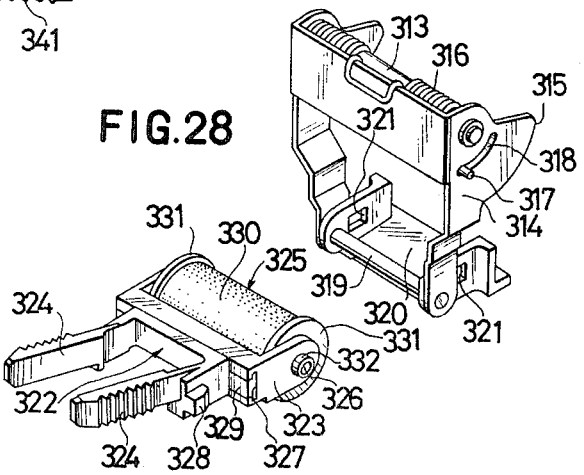
FIG. 28 is a perspective view of the inking device of FIG. 27 under the condition in which a cartridge frame and holder for an inking roller have been removed from a support member.
Figure 29:
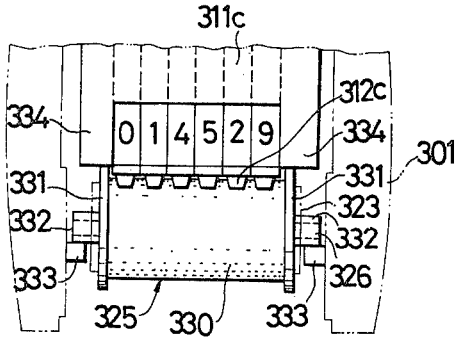
FIG. 29 is a fragmentary front elevational view showing one condition of the ink-impregnated roller body, wherein it has been restored to its original shape.
Figure 30:
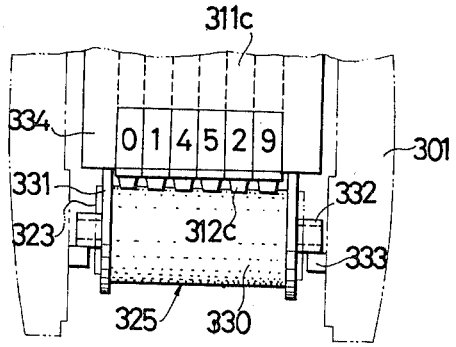
FIG. 30 is a view similar to FIG. 29, showing the condition in which the types are pushing into the ink-impregnated roller body.
Figure 31:
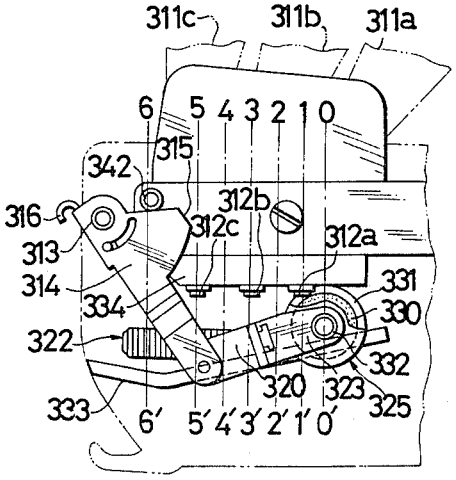
FIG. 31 is a fragmentary side elevational view of the fourth embodiment of the inking device.
Figure 32:
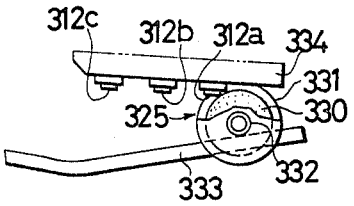
FIGS. 32 to 38 are a series of side elevational views showing various conditions of the fourth embodiment of the inking device, in which the axis of the inking roller is located on the lines 0—0′, 1—1′, 2—2′, 3—3′, 4—4′, 5—5′ and 6—6′ of FIG. 31, respectively.
Figure 33:
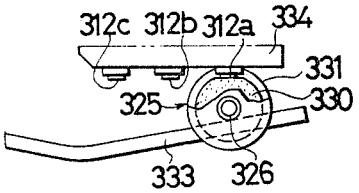
Figure 34:
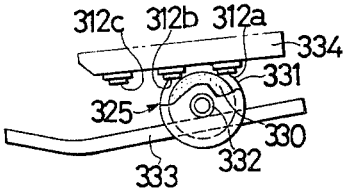
Figure 35:
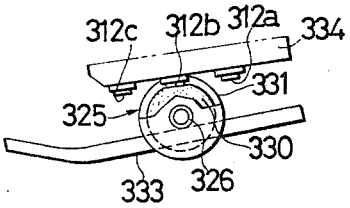
Figure 36:
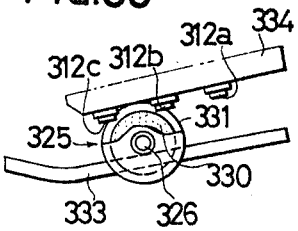
Figure 37:
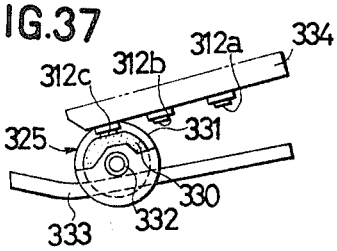
Figure 38:
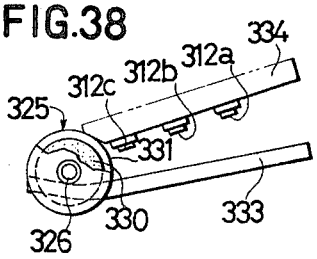

When the hand lever 303 is further gripped to its full stroke, the bearing plates 331 of the inking roller 325 are moved forward beyond the lower sides of the printing head frames 334. The bearing plates 331, inking roller 325 and rollers 326 ride upward on the upwardly inclined forward portion of rails 333 which raise the rollers 332, as shown in FIG. 25. Once the bearing plates are no longer pressed by frames 334, they stop just forward of the frames 334 and spring 316 presses the bearing plates lightly against the front of frames 334. Once the inking roller is forward of frames 334, the printing heads 311*a*, 311*b* and 311*c* are lowered to bring their respective printing surfaces 312*a*, 312*b* and 312*c* into engagement with the upper sides of the continuous label strip 339, and this prints the label 339*a* then beneath surfaces 312.

When the hand lever 303 is released from being gripped, the yokes 302 are moved clockwise or upward by the spring 309. The inking roller 325, which had been halted in front of the printing head frames 334, is returned backward along the guide rails 333 by the spring 316, because the spring biases the rocking arms 314 to restore their original position of FIG. 23.

The fifth embodiment of the present invention is now described in connection with FIGS. 39–43.

Figure 39:
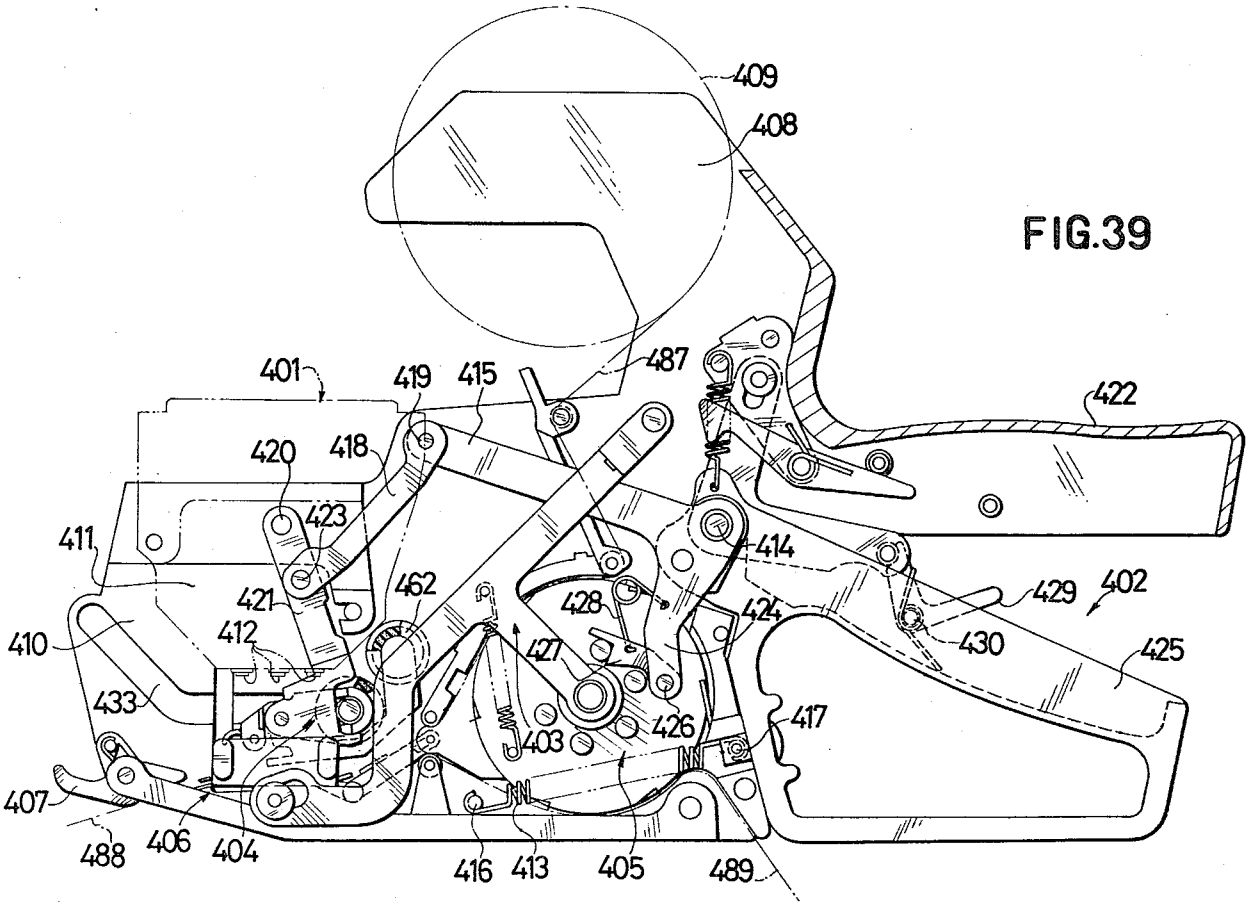
FIG. 39 is a partially cross-sectioned side elevational view of a portable labeling machine, equipped with a fifth embodiment of the ink supply device according to the present invention, with the flame plate on the viewer's side removed.
Figure 40:
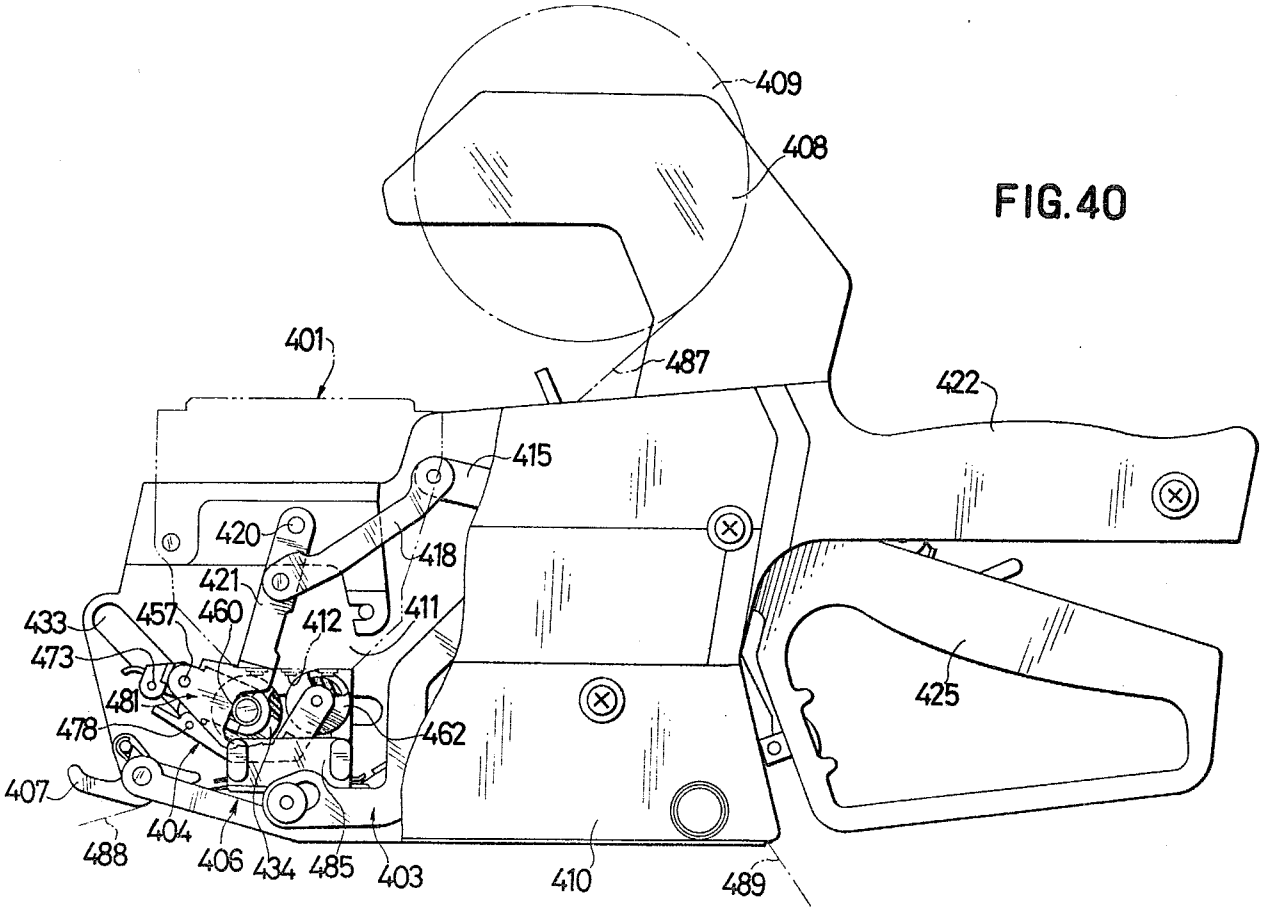
FIG. 40 is the same view as FIG. 39 with the hand lever gripped partially through its stroke.
Figure 41:
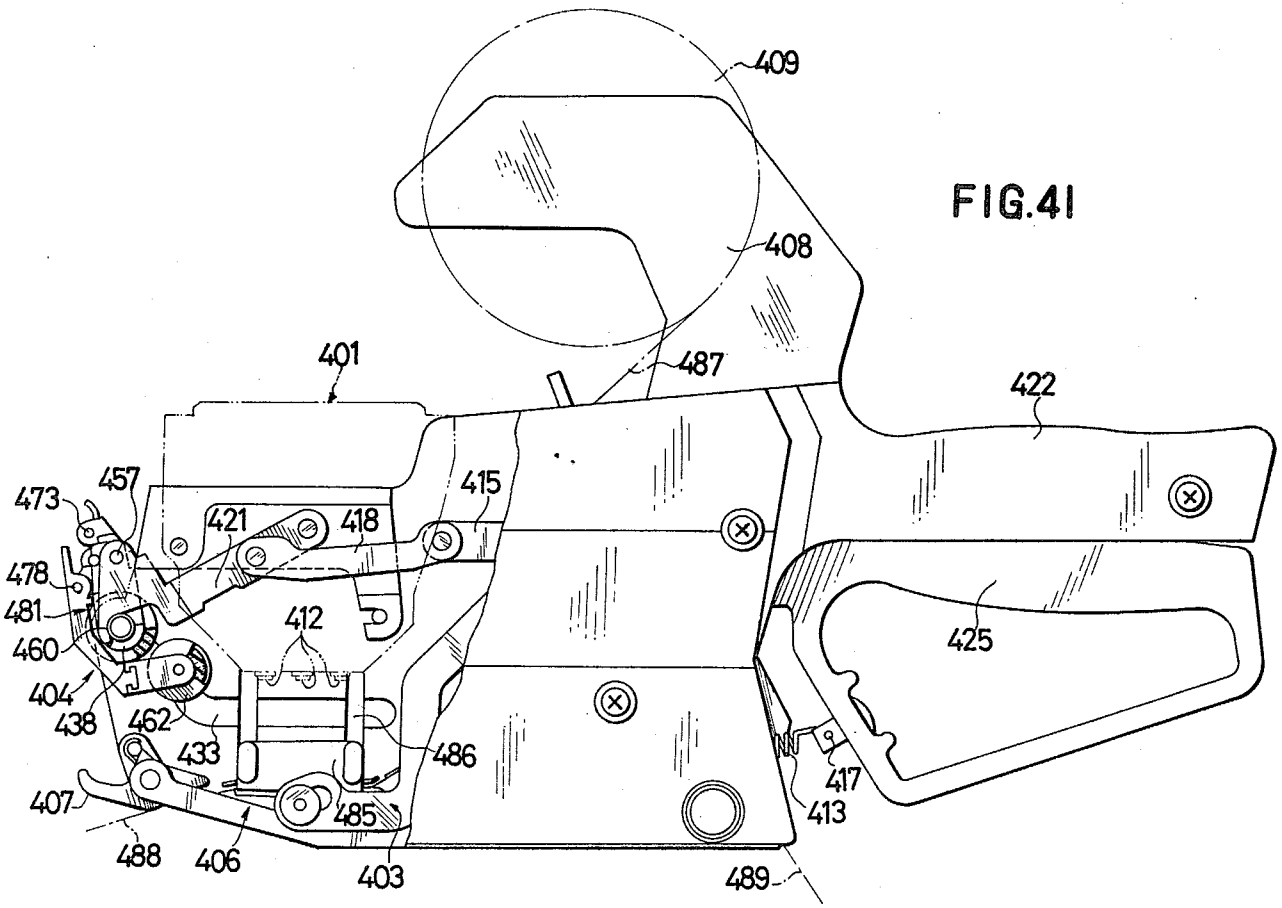
FIG. 41 is the same view as FIG. 39 with the hand lever gripped to its full stroke.

In FIGS. 39–41, the hand labeler includes a machine frame 410 comprised of two parallel, spaced apart plates. A printing mechanism 401 is immovably affixed to an upper front (left end) portion of the machine frame 410. A labeler drive mechanism 402 is mounted at a rear portion of the machine frame. The labeler drive mechanism 402 is comprised of a grip 422 and of a hand lever 425. A constant printing pressure mechanism 403 is located at a center portion of the frame 410. A label strip feed mechanism 405 is located at a lower center portion of the frame for feeding a label strip. A peeling mechanism 406 for peeling labels from the backing strip on which the labels are secured is located at a lower front portion of the frame. An applicator 407 for applying labels to commodities is located at the lower front end portion of the frame. A holder 408 for a continuous label strip 409 is located at an upper center portion of the machine frame 410. These features of a labeler are more thoroughly described in conjunction with prior embodiments in this application and in above noted application Ser. No. 681,251.

The printing mechanism 401 is comprised of three printing heads (not shown) of the type described herein. The printing heads are sandwiched between the side frames 411 of the printing mechanism 401. In this embodiment, the printing mechanism 401 is affixed stationary to the machine frame 410.

A series of below described labels 488 are printed by the printing types at the printing surfaces which are at the lower ends of the respective printing heads.

The grip 422 of the drive mechanism 402 is integral with the rear portion of the machine frame 410. The hand lever 425 is pivotally supported on a support shaft 414 that is affixed in position on the machine frame 410. The lever 425 pivots toward and away from the grip 422 about shaft 414. The hand lever 425 is biased clockwise in FIGS. 39–41 by drive springs 413. Springs 413 are interposed between a spring supporting pin 416 located on a lower center portion of the machine frame 410 and a spring pin 417 located on the hand lever 425.

Referring to FIG. 39, the hand lever 425 extends forwardly to and is an integral part of a pair of yokes 415 which themselves extend forward through the labeler. There are a pair of drive levers 418, which have rearward ends that are pivotally attached to the forward ends of respective yokes 415 by a pivot pin 419. The forward ends of the drive levers 418 are pivotally attached to a pair of rocking levers 421 by pins 423. Rocking levers 421 are pivotally supported on the printing mechanism frames 411 by fixedly located pivot pins 420. Pins 423 are beneath pins 420 and are intermediate the length of levers 421.

A pair of drive levers 424 depend beneath the rearward ends of yokes 415. Levers 424 drive the label strip feed mechanism 405. Hook support pins 426 are carried on the lower portions of the drive levers 424. A pair of hooks 427 are pivotally supported on pins 426. Springs 428 bias hooks 427 counterclockwise. The springs 428 are interposed under tension between hooks 427 and drive levers 424. The hooks 427 move the label feed mechanism as described in application Ser. No. 681,251.

A push member 429 is pivotally attached at an upper intermediate portion of the hand lever 425 by a pivot support shaft 430.

Figure 42:
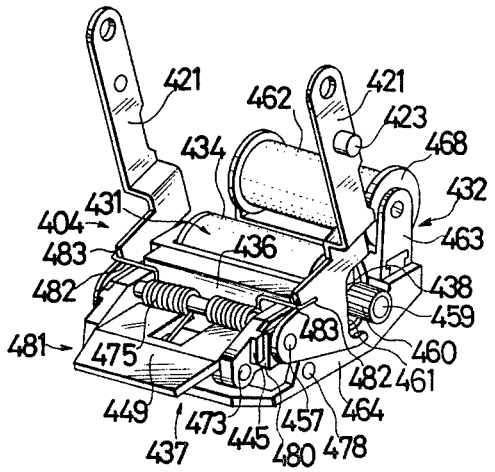
FIG. 42 is an enlarged perspective view showing the fifth embodiment of an ink supply device according to the present invention.
Figure 43:
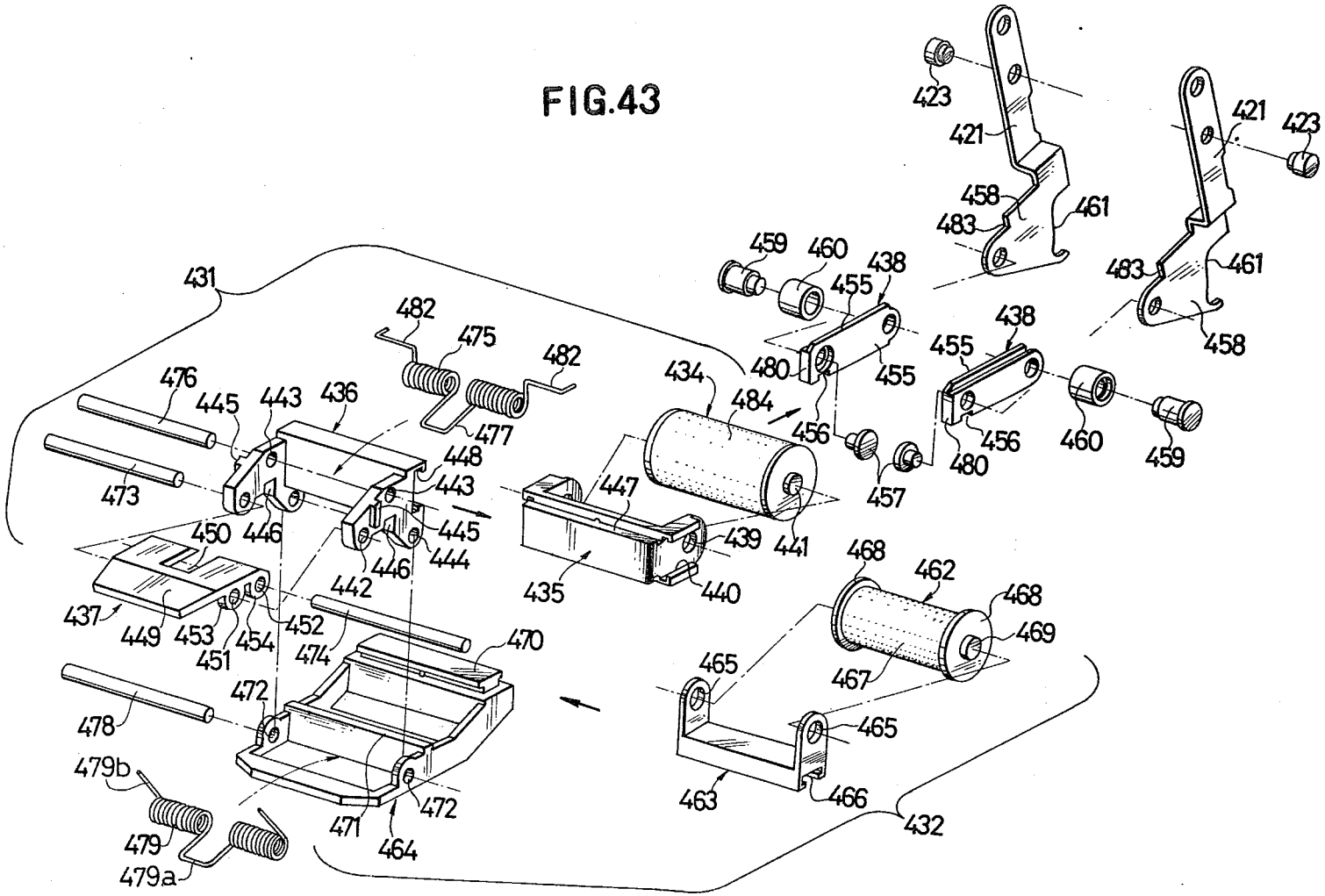
FIG. 43 is an exploded perspective view of the embodiment of the ink supply device shown in FIG. 42.

Turning to FIGS. 42 and 43, the ink supply device 404 according to the fifth embodiment of the present invention includes main inking roller assembly 431, auxiliary inking roller assembly 432, a pair of separated, opposedly positioned holding members 438, and the paired, opposed, cooperating rocking levers 421. The ink supply device also includes guide means for controlling motion of the inking mechanism. The guide means include a pair of guide grooves 433 which are formed in the inside walls of the machine frame 410 and a pair of rollers 460, described further below, which ride in grooves 433. (Also see FIGS. 49 and 41).

The main inking roller assembly 431 includes a main inking roller 434, an inking roller cartridge frame 435, a cartridge frame holder 436 (which holds both of the inking rollers), and a manually grippable pinch member 437.

The cartridge frame 435 has a U-shape. Each of its side legs is formed with a respective attaching hole 439 and with a respective pair of upper and lower retaining portions 440 of a generally C-shape, whose open sides face toward one another. The intermediate connecting web portion of the cartridge frame 35 has on its outer, forward facing surface an engaging land 447.

The main inking roller 434 has shaft ends 441 projecting therefrom. Shaft ends 441 are fitted in attaching holes 439 of frame 435, whereby the main inking roller 434 is removably attached to its cartridge frame 435.

The cartridge frame holder 436 is also of U-shape. It has leg portions that are formed with forward pin holes 442 and rearward pin holes 443. The holder 436 has a connecting web portion. Lower pin holes 444 are formed in the side legs at the connecting web portion. On the exterior of each leg of holder 436 there is a respective vertically extending, projecting stopper 435. The lower face of each leg portion of the holder 436 has a respective downwardly facing retaining recess 446 in which below described pin 474 may be fitted. The connecting web portion of the cartridge frame holder 436 has a generally C-shaped retaining portion formed on its outer, rearwardly facing surface, with the C-shape opening rearwardly of the holder. The engaging land 447 of the cartridge frame 435 is slid into and securely fitted, in tongue-in-groove fashion, into the retaining portion 448 of the holder 446.

The pinch member 437 has a planar forward end which includes the pinch element 449. The rearward end of pinch member 437 includes a rectangularly shaped notch 450 which provides clearance for portion 477 of below described spring 475. The lower face of the pinch member 437 at its rearward end and at both sides of the pinch member supports two pairs of semicircularly shaped downwardly depending projections 453 and 454. The projections 453, 454 respectively include forward pin holes 451 and rearward pin holes 452.

Each of the opposed, spaced apart holding members 438 has an elongated, thinner width projection 455 formed on both of its upper and lower edges. Retaining notches 456 are defined at the lower surfaces of the front portions of the holding members 438. The C-shaped retaining portions 440 at both sides of the cartridge frame 435 receive the upper and lower projections 455 of the holding members 438. The below described pin 474 is retained in the retaining notches 456.

The forward ends of the holding members 438 are pivotally connected by pins 457 to the forward ends of the lower side plates 458 of the rocking levers 421. A pair of guide rollers 460 are rotatably attached at the rear ends of the holding members 438 by pins 459. The guide rollers 460 are received in and turn in and move through the guide grooves 433 that are formed in the inner faces of the side walls of machine frame 410. For reasons described below, the width of the guide grooves 433 is slightly larger than the diameters of the guide rollers 460.

The lower portions of the rocking levers 421 are widened so as to define the widened side plates 458 thereof. As noted above, the forward end portions of the holding members 38 are pivotally attached by pins 457 to the forward ends of the side plates 458. The rear end portions of the side plates 458 of rocking levers 421 are cut out to form rearwardly facing open notches 461. As seen in FIG. 42, the guide rollers 460 are positioned in the notches 461, and the positioning of the rollers and the shape of the notches are such that the rollers do not contact the walls defining the notches 461 during motion of the rocking levers 421.

The auxiliary inking roller assembly 432 includes the auxiliary inking roller 462, an auxiliary roller cartridge frame 463 and an auxiliary roller cartridge holder 464.

The cartridge frame 463 is of U-shape. Its upstanding leg portions have respective attaching holes 465 therethrough. The connecting web portion of frame 463 includes a generally C-shaped retaining groove extending thereacross and facing outwardly of the cartridge frame 463.

The auxiliary inking roller 462 includes an ink-impregnated spongy roller body 467 and also includes a pair of externally mounted bearing plates 468 which are attached concentriccally at both ends of the roller body 467 and which have a larger diameter than the roller body. Shaft ends 469 concentric with roller body 467 project sideways from the bearing plates 468. Shaft ends 469 are received in the attaching holes 465 of frame 463, thereby to rotatably attach the auxiliary inking roller 462 to the auxiliary roller cartridge frame 463. The outer peripheries of the bearing plates 468 are engageable with the lower surfaces of the stationary printing mechanism frames 411, whereby the bearing plates 468 are guided and in turn, guide their roller 467 for movement across the printing surfaces 412.

The auxiliary cartridge frame holder 464 includes an engaging land 470 that projects above the upper surface of the rear end portion of the holder 464. A stopper 471 projects above the intermediate portion of the holder 464. Pin holes 472 are formed in the side plates of the frame holder 464 forwardly of the stopper 471.

The above described elements of the ink supply device 404 are assembled as now described.

In the main inking roller assembly 431, the cartridge frame 435 has the main inking roller 434 attached to it. This combined sub-assembly is then attached to the frame holder 436 by sliding of the forward engaging land 447 into the C-shaped retaining opening 448 of the frame holder 436, for a tongue-in-groove connection. The pinch member 437 is next inserted into the space between the leg portions of the frame holder 436 until the forward and rearward pin holes 451, 452 are in registry with the corresponding forward pin holes 442 and rearward notches 446 of the frame holder 436. The pins 473 and 474 are next inserted through the front pin holes 451, 452 and through the rear pin holes 452 and notches 446, respectively. That pin 474 passes through the open sided notch 446 enables the pinch member 437 to be pivoted with respect to the frame holder 436, as described below.

A pin 476 is inserted through one of the rear pin holes 443, is passed through the winding of the torsion spring 475 and is then inserted through the other rear pin hole 443. The end portions 482 of the torsion spring 475 project beyond the sides of frame 436 and are retained on the stepped portions 483 at the forward sides of the lower side plates 458 of the rocking levers 421. The center abutment portion 477 of the spring 475 abuttingly engages the upper side of the above mentioned pin 473 and pushes the pin downwardly. This biases the entire main inking roller assembly 431 counterclockwise about pins 457. The main inking roller 434 is continuously biased toward the printing surfaces 412 of the printing mechanism 401, within the range of motion permitted by the guide grooves 433.

In the auxiliary inking roller assembly 432, the auxiliary inking roller 462 is attached to the cartridge frame 463. This subassembly is attached to the holder 464 by means of the land 470 on the holder 464 being slid sideways into the correspondingly shaped retaining groove 466 on the frame 463. Next, the pinholes 472 of the holder 464 are moved into registry with the lower, rearward pinholes 444 of the frame holder 436. A pin 478 is inserted through one of the sets of registered holes 472, 444, then through the winding of torsion spring 479 and finally through the other set of registered holes 444, 472. The central operating portion **479*a* of the torsion springs 479 presses downwardly against the portion of the holder 464 forward of the shaft 478. The free arms 479 of the torsion spring 479 are engaged against the forward, lower edge of the connecting web portion of the frame holder 36 and this serves as the abutment enabling the torsion spring to push against the frame holder 464. The torsion spring 479 biases the entire auxiliary inking roller assembly 432 counterclockwise about the pin 478**.

A combined assembly 481 comprised of the main inking roller 431 and the auxiliary inking roller 432 is removably attached to the holding members 438 which are, in turn, pivotally attached to the rocking levers 421. The C-shaped retaining portions 440 of the cartridge frame 435 are pushed forwardly or rearwardly while in sliding engagement with the projections 455 on the upper and lower edges of the holding members 438, until the front end faces 480 of the holding members 438 abut the stoppers 445 on the exterior of the legs of the frame holder 436. Now, assembly of the inking device is complete.

Referring to FIG. 42, in the assembled ink supply device 404, the retaining notches 456 of the holding members 438 register with the retaining recesses 446 of the frame holder 436. The pin 474 attached to the pinch member 437 is received in the aligned notches 456 and recesses 446.

For disassembling the combined assembly 481, the pinch element 449 of the pinch member 437 is pinched and moved upwardly. This moves the pinch member 437 clockwise about the pin 473. Such motion removes the pin 474 from the retaining notches 456 of the holding members 438. The pinch element 449 is then pulled forward (to the left) and the combined assembly 431 is separated from the holding members 438 by pulling upon the pinch element 449 until the retaining portions 440 are slid free of the projections 455.

To service or replace either of the main inking roller 434 or the auxiliary inking roller 462, e.g. because their ink supplies are exhausted, the combined assembly 481 is first removed from the holding members 438, as described above. Then the respective cartridge frame 435 or 463 is removed from its respective cartridge frame holder 436 or 464 together with the attached inking roller. The respective cartridge frames may be discarded or, at the least, their inking rollers may be separated therefrom and discarded. A new cartridge frame 435 or 463 having a new ink impregnated inking roller 484 or 467 is incorported into its respective frame holder 436 or 464, thereby to reconstruct the combined assembly 481, which is then remounted in the holding members 438.

The operation of the fifth embodiment of the ink supply device of the present invention is now described. When the hand lever 425 is gripped upward toward the grip 422, from the position of FIG. 39 to the position of FIG. 40, the rocking levers 421 are rotated clockwise, as viewed in FIG. 40, about the pins 420 through the motion of the drive levers 418 connected to the yokes 415. This moves the combined assembly 481, comprised of the main inking roller assembly 431 and the auxiliary inking roller assembly 432, which is attached to the holding members 438 and which is pivotally connected to the rocking levers 421, to move forward through the labeling machine. The main inking roller 434 rolls over the printing surfaces 412 of the stationary print heads 401. Because the guide rollers 460 on the holding members 438 are guided through the guide grooves 433 in the inside walls of the machine frames 410, the main inking roller is rolled over the printing surfaces 412 with a predetermined pressure determined by the position of the grooves 433 and the printing surfaces 412 and the size of the main roller 434.

The width of the guide grooves 433 is slightly larger than the diameters of the guide rollers 460. The depth of the depression produced in the ink roller body 484 by a printing type at the printing surface 412 is predetermined to be slightly larger than the difference between the width of the grooves 433 and the diameter of the guide rollers 460. The depth of the depression in the ink roller body 484 can be determined by the placement of the elements described just above. As a result, the main inking roller 434 rolls over the printing surfaces 412 and applies a constant, proper pressure to the printing surfaces, without the axis of the roller 434 either approaching too near or moving too far from the printing surfaces 412. The restoration of the shape of the ink impregnated ink roller body 484 pumps ink to the periphery of the main inking roller 434. As a result, all of the ink in the main inking roller 434 can be used up and ink is aplied to the printing surfaces 412 in sufficient quantity and uniformly.

Furthermore, because the main inking roller 434 is biased upwardly at all times by the torque force exerted by the torsion spring 475, as described above, the main inking roller 434 does not move away from the printing surfaces 412 while it is applying the proper amount of ink thereto, even if the roller 434 has a slight error or distortion in its shape ordiameter.

As shown in FIG. 40, the auxiliary inking roller 462 is disposed to the rear of the main inking roller 434. Auxiliary inking roller 462 is biased by torsion spring 479 against the printing surfaces 412. The depth of the depression into the body 467 of the auxiliary inking roller is regulated by the size of the bearing plates 468 in engagement with the surfaces of the printing mechanism frames 411. This aspect of inking roller construction was discussed in connection with the second embodiment of this invention. The auxiliary inking roller 462 follows the main inking roller across the printing surfaces 412 to finish off the application of ink to the printing surfaces. With two ink application rollers, ink application is assured of being uniform and the entire printing surface is assured of receiving ink.

When the hand lever 425 is fully gripped, as shown in FIG. 41, the combined assembly 481 is moved forward of the printing surfaces 412 and then upward along the upwardly curving guide grooves 433 until the combined assembly 481 stops forward of the printing mechanism 401.

While the combined assembly is positioned in front of the printing mechanism 401, a platen 485, whose operation is not described here, is rapidly moved upward and then downward along vertical grooves 486. This moves a label 488 of continuous label strip 487, which label has been fed onto the platen 485, into engagement with the printing surfaces 412. Individual labels 488 on the strip 487 are thus printed.

When the hand lever 425 is released from its gripped condition the combined assembly 481 retracts to the position shown in FIG. 39. Meanwhile, the label strip 487 is separated at the peeling mechanism 406 into the individual imprinted labels 488 and their paper backing strip 489. The printed labels 488 are then fed beneath the applicator 407 to be applied to commodities.

The sixth embodiment of ink supply device of the present invention is now described in connection with FIGS. 44–47.

The labeler which includes this embodiment of the ink supply device has spaced apart parallel frames 501 which extend from the front (the left in FIG. 44) to the rear of the labeler. A grip 502 is integrally attached to and extends back from the machine frames 501. A hand lever 504 is pivotally supported between frames 501 and pivots about pin 503 in frames 501. The forward portion of hand lever 504 forms bifurcated yokes 505. A printing mechanism 507 is affixed to the forward end portion of the yokes 505. The printing mechanism 507 is illustrated as including two printing heads 506.

A spring support pin 560 is mounted in the grip 502. Another spring support pin 561 is attached to the hand lever 504. A drive spring 562 is interposed under tension between the pins 560 and 561, whereby the yokes 505 and the hand lever 504 are biased to normally turn clockwise about the shaft 503.

Referring to FIG. 1, there is a label cutting mechanism 542, including a cutting blade 543 which is movably held in a blade support 544. The label feed mechanism 545 is coactive with a feed roller 551 of the cutting mechanism 542 through gear mechanisms 549 and 550. There is a cut label feed mechanism 545, including a silicone treated, endless belt 548 which runs around a larger rear roller 546 and a smaller forward roller 547.

Figure 44:
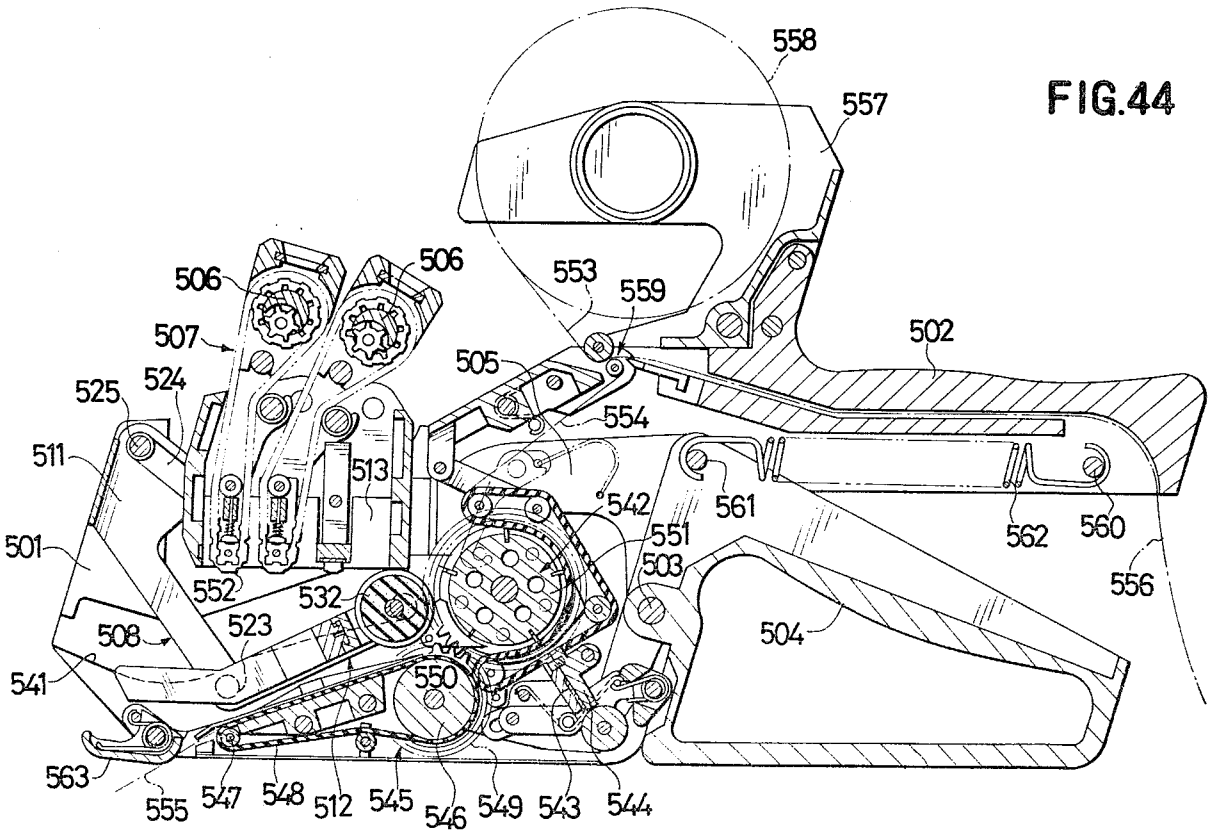
FIG. 44 is a longitudinal cross-sectional view of a portable labeling machine which is equipped with an ink supply device exemplifying a sixth embodiment of the present invention.
Figure 45:
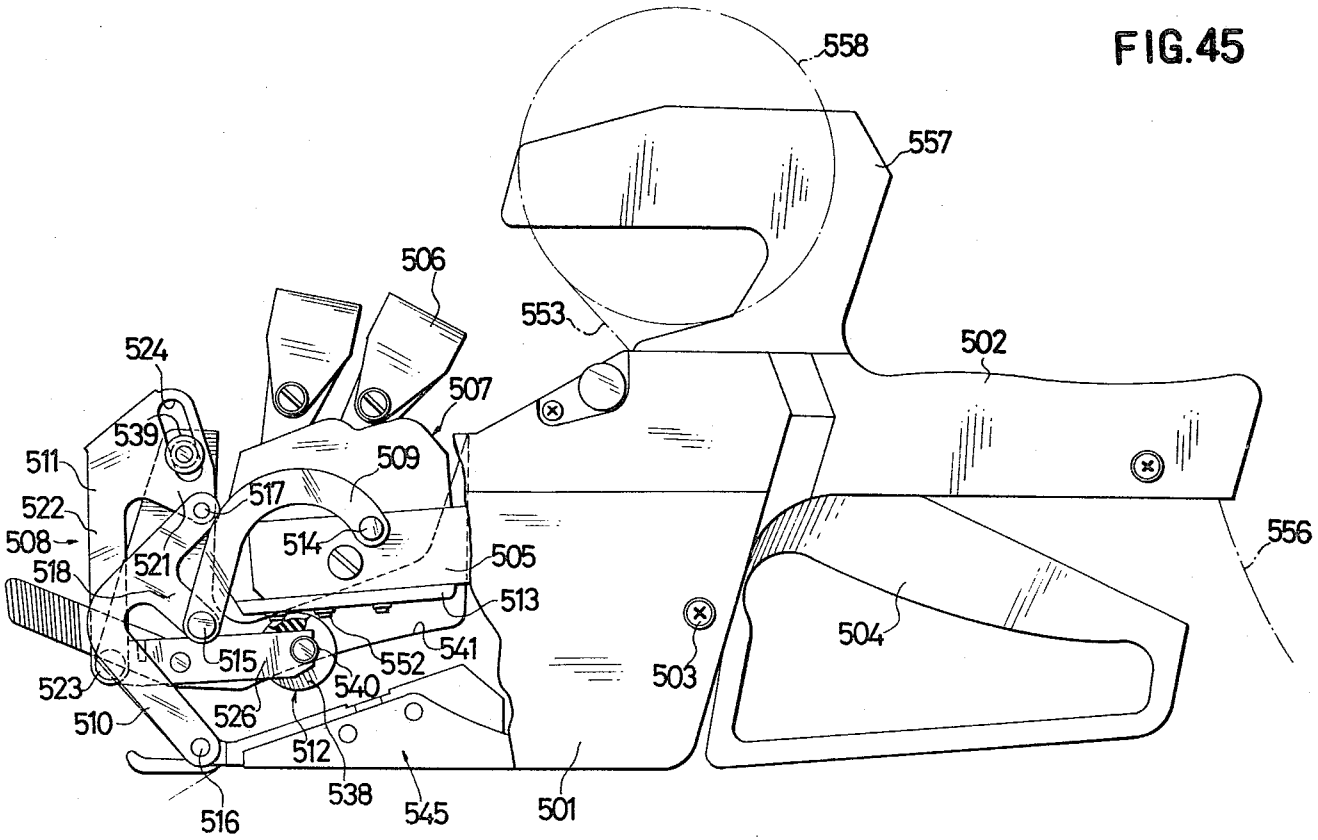
FIG. 45 is a simplified side elevation of the labeling machine of FIG. 44 with the frame plate on the viewer's side removed, under the condition, in which the hand lever is gripped midway of its full stroke.
Figure 46:
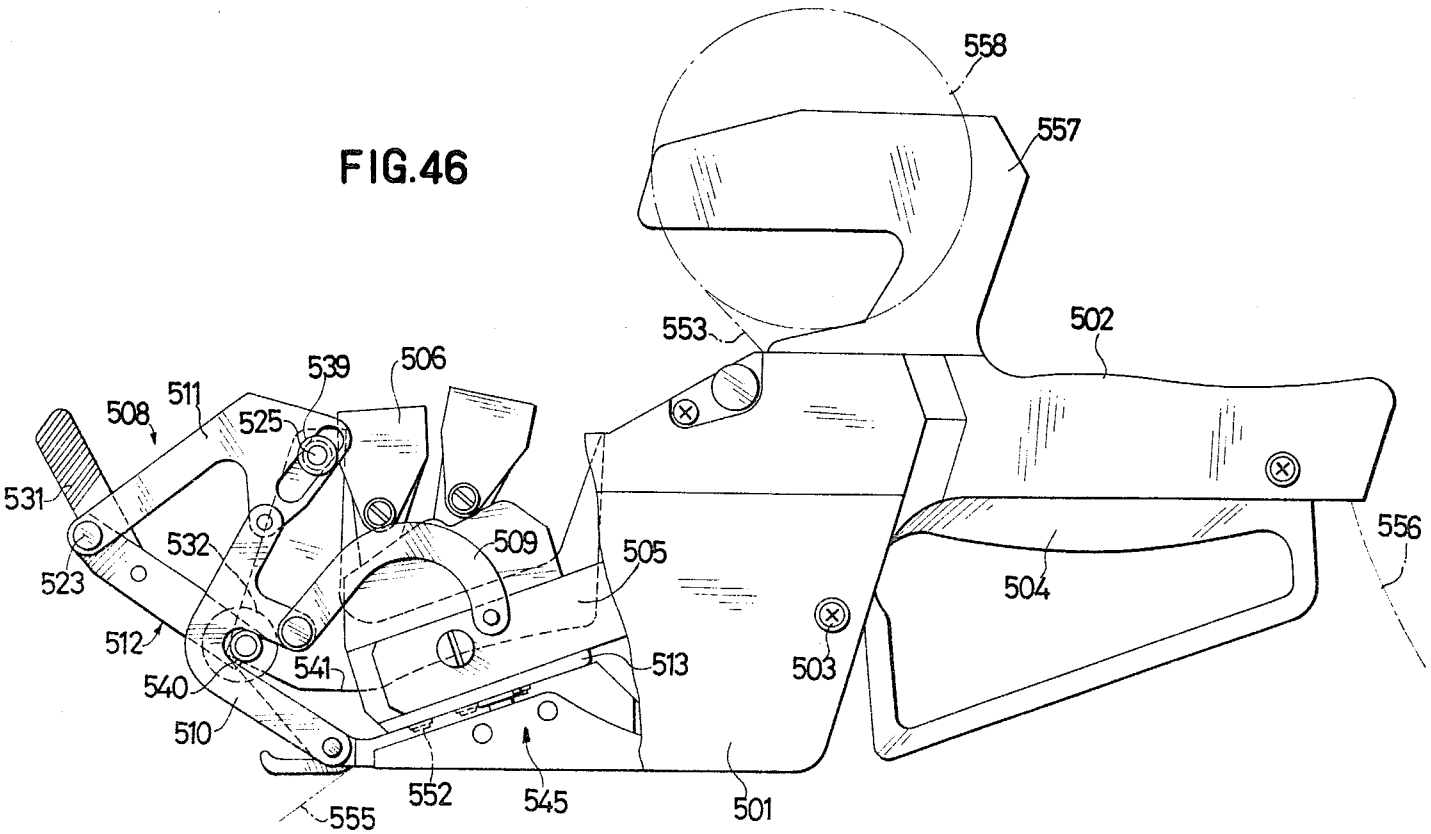
FIG. 46 is the same view as FIG. 45, but showing the condition, in which the hand lever is gripped to its full stroke.
Figure 47:
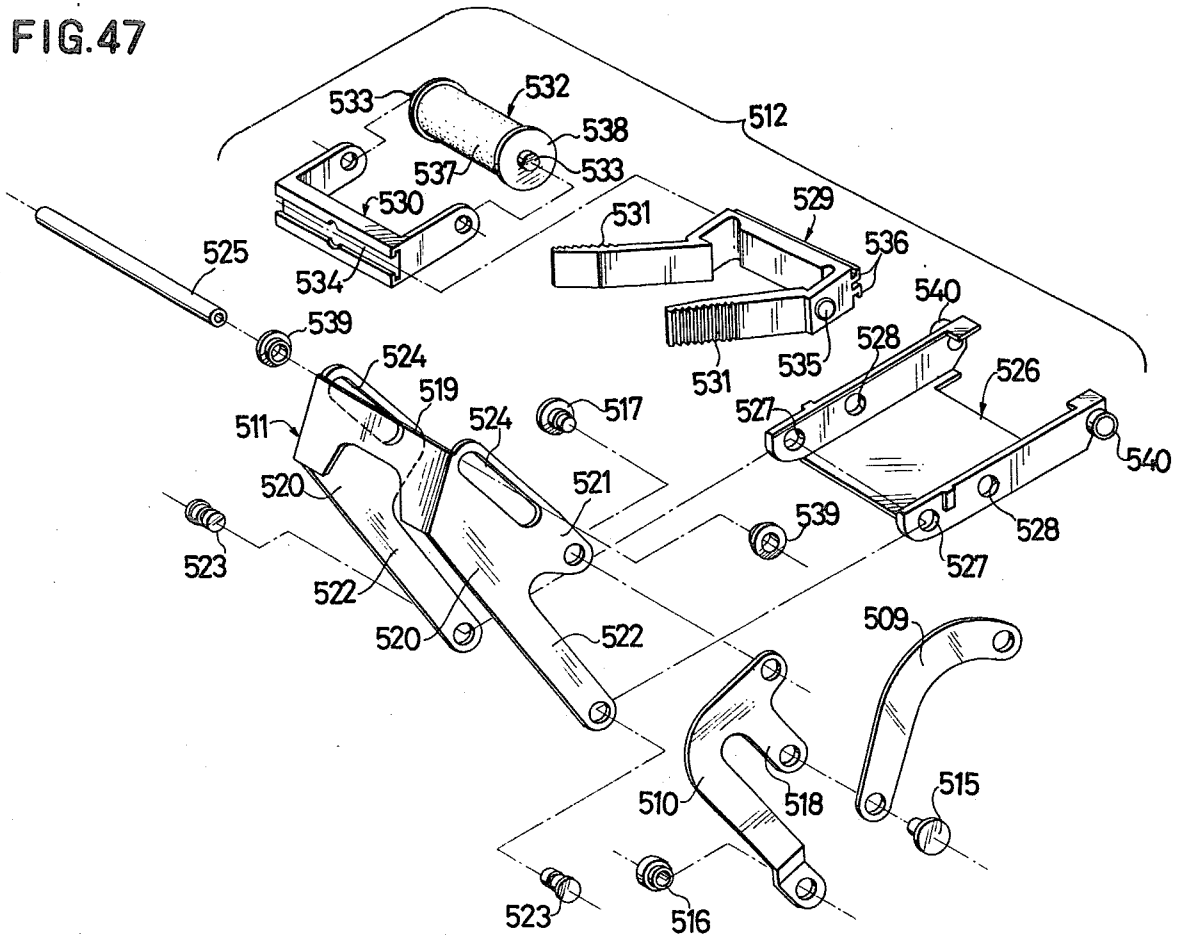
FIG. 47 is an exploded perspective view of the ink supply device according to the sixth embodiment of the present invention.

The ink supply device 508 according to the sixth embodiment of the present invention is particularly shown in FIGS. 45–47. It is comprised of a curved, C-shaped drive link 509, and F-shaped rocking link 510, a hatchet-shaped or L-shaped rocking frame 511, and an ink applying portion 512. (The near side of ink supply device 508 cannot be seen in FIG. 44, because FIG. 44 is a longitudinal cross-sectional view.)

The drive link 509 has its upper or rearward end pivotally connected by pivot shaft 514 to the outside of that yoke 505 on the same side of the ink supply device as the link 509. The lower, forward end of link 509 is pivotally attached by pivot shaft 515 to the free end of the intermediate arm 518 of the F-shaped rocking link 510.

The rocking link 510 has a lower crossbar which is pivotally connected by shaft 516 to the lower front end portion of the machine frame 501. The top end of link 510 at the end of its upright leg is pivotally connected by shaft 517 to the rearward end of the shorter portion 521 of the below described rocking frame 511.

Referring to FIG. 47, the rocking frame 511 is a U-shaped, integral structure comprised of a center connecting web portion 519 and of two generally hatchet or L-shaped side portions 520. The side portion 520 that is nearest link 509 includes the shorter or hatchet blade portion 521, which projects from the upper portion of the respective one of the longer portions 522 of the side portion 520. This shorter portion 521 has a hole through its rearward, lower end. Pivot shaft 517 passes through this hole and pivotally connects this shorter portion 521 to the top or end of the upright leg of the rocking link 510. The lowermost ends of both of the longer portions 522 are pivotally connected by pins 523 to openings 527 at one end of a support member 526, described below.

At the rear of the upper end portions of both side portions 520, elongated slots 524 are formed. A respective roller 539 is slidably fitted in each slot 524. Both rollers 539 are loosely fitted in their slots for free rotation on a pin 525 which extends between the inside walls of, and is located at the upper front ends of, the machine frames 501. Pin 525 fixedly locates the rollers 539 in the frames, while permitting them free rotation.

The ink applying portion 512 of the ink supply device is described with reference to FIG. 47. It includes the support member 526, which is rotatably attached by pins 523 to the lower free ends of the longer portions 522 of the rocking frame 511. The support member 526 has side plates. Both side plates of the support member have respective openings 527 formed in their forward portions, and have openings 528 formed in their middle portions. A pair of guide rollers 540 are rotatably attached at the outsides of the rear portions of the side plates of support member 526.

A U-shaped, resilient material holder 529 is removably attached to the support member 526. At the outsides of both legs of the holder 529, near the connecting web thereof, there are projections 535 which may be fitted into the openings 528 of the support member 526. The forward, free ends of the legs of holder 529 are formed into pinch portions 531, which can be pinched together at their outer faces. Pinching of pinch portions 531 enables insertion and removal of projections 535 in openings 528. There is a pair of longitudinally extending vertically and oppositely projecting opposed ridges 536 at the rear or bottom of the connecting portion of the holder 529 which can be fitted in the engagement groove 534 of the below described cartridge-type frame 530.

The cartridge type frame 530 may be comprised of resilient material (if it is desired to reuse the cartridge for another inking roller 532) and has a U-shape. An inking roller 532 is rotatably supported on both legs of the frame 530 by means of the shafts 533 that project from the ends of the rollers 532. Where frame 530 is fabricated of resilient material, the shafts 533 may be snapped into and out of the holes at the ends of the legs of frame 530. The bottom or forward edge of the connecting web portion of the U-shaped frame 530 has an engagement groove 534 defined in it, which groove can receive the above described ridges 536 of holder 529 in tongue-in-groove fashion. In this manner, the frame 530 is removably attached to the holder 529. Frame 530 is also thereby joined to support member 526, thereby completing the ink applying portion 512. By means of the ink applying portion 512, the inking roller 532 is removably attached to the portable labeling machine.

FIGS. 44–46 show that the inking roller 532 is arranged eccentrically of and slightly forward of the guide rollers 540. Even when the inking roller 532 moves to its most forward position, shown in FIG. 46, the guide rollers 540 are prevented from running off the front ends of the guide grooves 541 to the outside of the portable labeling machine.

Once the ink in the inking roller 532 is exhausted, the roller 532 should be replaced. The pinch portions 531 of the holder 529 are pinched together. This deforms both side plates of the holder 529 so that its projections 535 are released from the openings 528 of the support member 526. The frame 530, still carrying the inking roller 532, is thus removed from the support member 526, together with the holder 529. Now, the frame 530 and the holder 529 are slid in opposite, sideways directions, thereby sliding the ridges 536 out of their engagement with the groove 534. If the construction of the frame 530 permits, a new inking roller 532 is substituted in the frame 530. A new cartridge type frame 530, which is rotatably supporting another inking roller 532, with new ink impregnated roller body 537, is attached to the holder 529. The pinch portions 531 of the holder 529 are again pinched together, enabling the projections 535 to again be fitted in the openings 528 of the support member 526. The new inking roller 532 is mounted in the support member 526, together with the holder 529.

The inking roller 532 is comprised of a spongy, ink impregnated roller body 537 and is also comprised of the bearing plates 538, which have a slightly larger diameter than the roller body 537, and are integrally attached at the outsides of body 537.

Referring to FIGS. 45 and 46, a pair of parallel guide grooves 541 are formed in identical corresponding positions in both of the inside walls of the machine frames 501. The grooves 541 incline gradually downwardly moving forwardly through the labeler. Forward of the print head 507, however, the rails 541 gradually incline upwardly. The guide rollers 540 of the support member 526 are positioned to roll over the upper surfaces of the guide grooves 541 and the rollers move downwardly along the incline of the grooves 541. Other guide means, such as a pair of guide rails on the opposite inside walls of the machine frames, may be substituted for the grooves 541.

The bearing plates 538 roll under and against the lower surfaces of the frames 513 of the printing mechanism. This is also the lower surfaces of the yokes 505. The inclination of the lower surfaces of frames 513 is such that these surfaces and the grooves 541 would, if extended, intersect at an acute angle, as in the above described second embodiment. Further, the lower surfaces of the frames 513 and the grooves 541 cooperate with the inking roller in substantially the same manner as described in the second and fifth embodiments, except, as described below, the contact between the bearing plates 538 and the frames 513 is not the principal impetus to motion of the inking roller 532.

The operation of the ink supply device 508 according to the sixth embodiment of the present invention is now described. As the hand lever 504 is gripped to pivot counterclockwise toward the grip 502, the yokes 505 also pivot counterclockwise (or downward) about the support shaft 503, as shown in FIGS. 45 and 46. Then the drive link 509, which is pivotally connected to a yoke 505 and to the rocking link 510 moves both downwardly and clockwise and the rocking link is moved forward by the drive link 509. The fastening of the rocking link 510 at shaft 516 causes the forward motion of the rocking link 510 to be a counterclockwise rotation.

As the rocking link 510 pivots forward about the shaft 516, the engagement at shaft 517 between links 510 and 511 generally pivots the rocking frame 511 clockwise about rollers 539. The bottom ends of the longer portions 522 of the rocking frame 511 are pivotally connected to the support member 526 of the ink applying portion 512. As the longer portions 522 pivot, they also shift downwardly due to the different direction along which ink applying portion 512 is directed to move. Thus, as the ink applying portion 512 is moved forward as a whole through the support member 526, the slots 524 slide along the loosely fitted rollers 539 and are guided thereby. The whole rocking frame 511 moves forward while turning clockwise about the shaft 517. This also moves the holder 529 and the cartridge type frame 530, which are attached to the support member 526.

As the ink applying portion 512 moves forward, the guide rollers 540, which are rotatably attached to the rear end portion of the support member 526, roll over the upper surfaces of the guide grooves 541 of the machine frames 501. At the same time, the bearing plates 538 on the inking roller 532 roll against the lower surfaces of the frames 513 of the printing mechanism 507. Unlike the second embodiment, however, the engagement between the frames 513 and bearing plates 538 is not what primarily moves the roller 532 forward through the labeler. Instead, the above noted links do this. The guide grooves 541 and bearing plates 538 ensure that the ink impregnated spongy roller body 537 will always roll over the printing surfaces 552 of the printing heads 506 with a predetermined pressure, thereby to apply ink to the printing surfaces 552. Why the proper inking pressure is obtained has been reviewed above in the previous embodiments.

When the hand lever 504 is gripped to its full stroke, as in FIG. 46, and the bearing plates 538 of the inking roller 532 move forward past and out of engagement with the lower surfaces of the printing mechanism frames 513, then the rollers 540 move upward along the upwardly inclined forward portions of the guide grooves 541. This frees the inked printing heads 506 to be moved downwardly to bring their printing surfaces 552 into engagement with a label 555 that is fed to the print position upon the belt 548 of the label feed mechanism 545.

The treatment of the label 555 is now described. Referring to FIG. 44, a continuous label strip 553 is fed from a roll 558, which is rotatably supported on a plate 557, which projects above the labeling machine frames. The label strip 553 is divided into a strip of adhesive backed labels 554 and a strip of backing paper 556, said division occurring at a label peeling portion 559 at the top of the frame of the labeler. The separated label strip 554 is then fed to the cutting mechanism 542, where the label strip is cut into a series of labels 555 of a predetermined length. The cutting is performed by the cutting blade 543, which acts in response to the motion of the hand lever 504. The now cut labels 555 are next fed onto the belt 548 in response to the biasing return force of the drive spring 562, which spring is released to operate upon release of the hand lever 504, as described below.

When the hand lever is released from being gripped, the whole labeler returns from its position of FIG. 46 to its position of FIG. 44. The yokes 505 are raised and pivoted clockwise by the drive spring 562. The drive link 509, the rocking link 510 and the rocking frame 511 all move opposite to their motions during the gripping of the hand lever 504. This retracts the ink applying portion 512 to the rear of the labeler as its guide rollers 540 roll along the guide grooves 541. During the retraction, the label feed mechanism 545 is actuated by a known ratchet linkage (not shown), which is connected to hand lever 504 and which moves the belt 548 a predetermined distance during each gripping cycle of the hand lever 504. The previously printed label 55 is fed below the label applicator 563, while at the same time, the next label 555, which has been cut by the cutting blade 543, but which has not yet been printed, is fed below the printing mechanism 507.

Subsequent operation of the grip lever repeats the foregoing operation.

The seventh embodiment of the inking device of the present invention is now described with reference to FIGS. 48–53.

The labeler containing this embodiment includes two parallel, spaced apart cooperating frames defining a machine frame 602. An ink supply device A according to this embodiment is disposed at a front portion of the labeler. Grip 601 extends rearwardly from the frame 602 of the labeler. A hand lever 603, which is pivotally attached to the machine frame 602 by the fixedly located pivot support shaft 604, can be squeezed toward and away from the grip 601. A tensioned drive spring 605, which is connected between pins on the grip and on the hand lever, biases the hand lever 603 clockwise to its position shown in FIG. 1. A pair of yokes 606 attached to and movable together with the hand lever 603 extend forwardly of the support shaft 604. Yokes 606 have a printing mechanism B of any of the previously described kinds attached at the forward ends of the yokes.

The ink supply device A of the present invention extends between the intermediate portions of the paired yokes 606 and between the upper and lower forward end portions of the machine frame 602.

Figure 52:
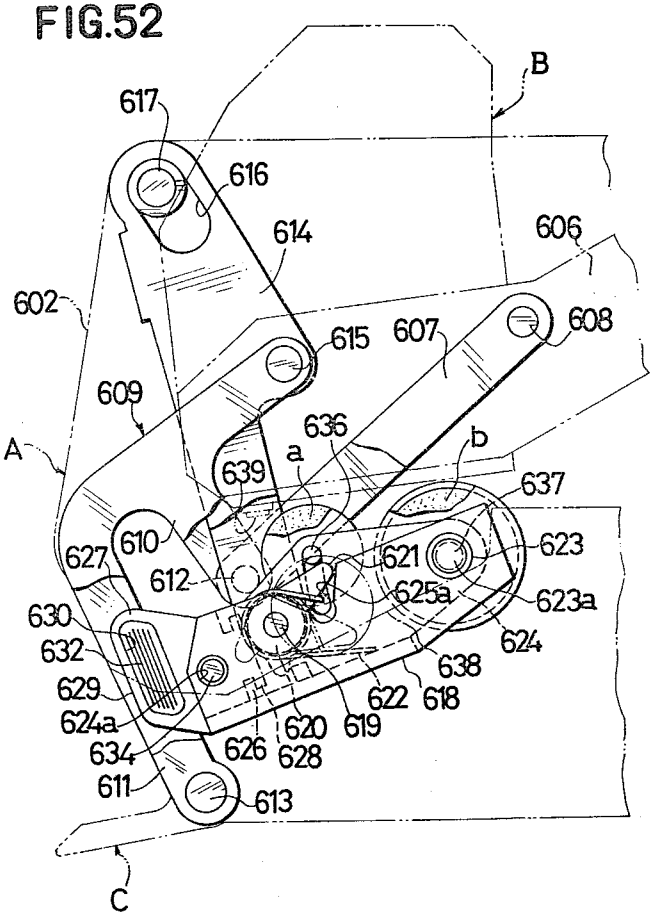
FIG. 52 is an enlarged side elevational view of a fragment of the labeling machine explaining the operation of the ink supply device.
Figure 51:
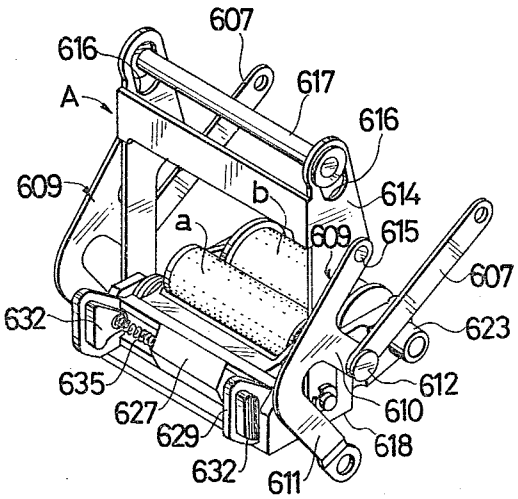
FIG. 51 is a perspective view of the seventh embodiment of the ink supply device according to the present invention.
Figure 53:
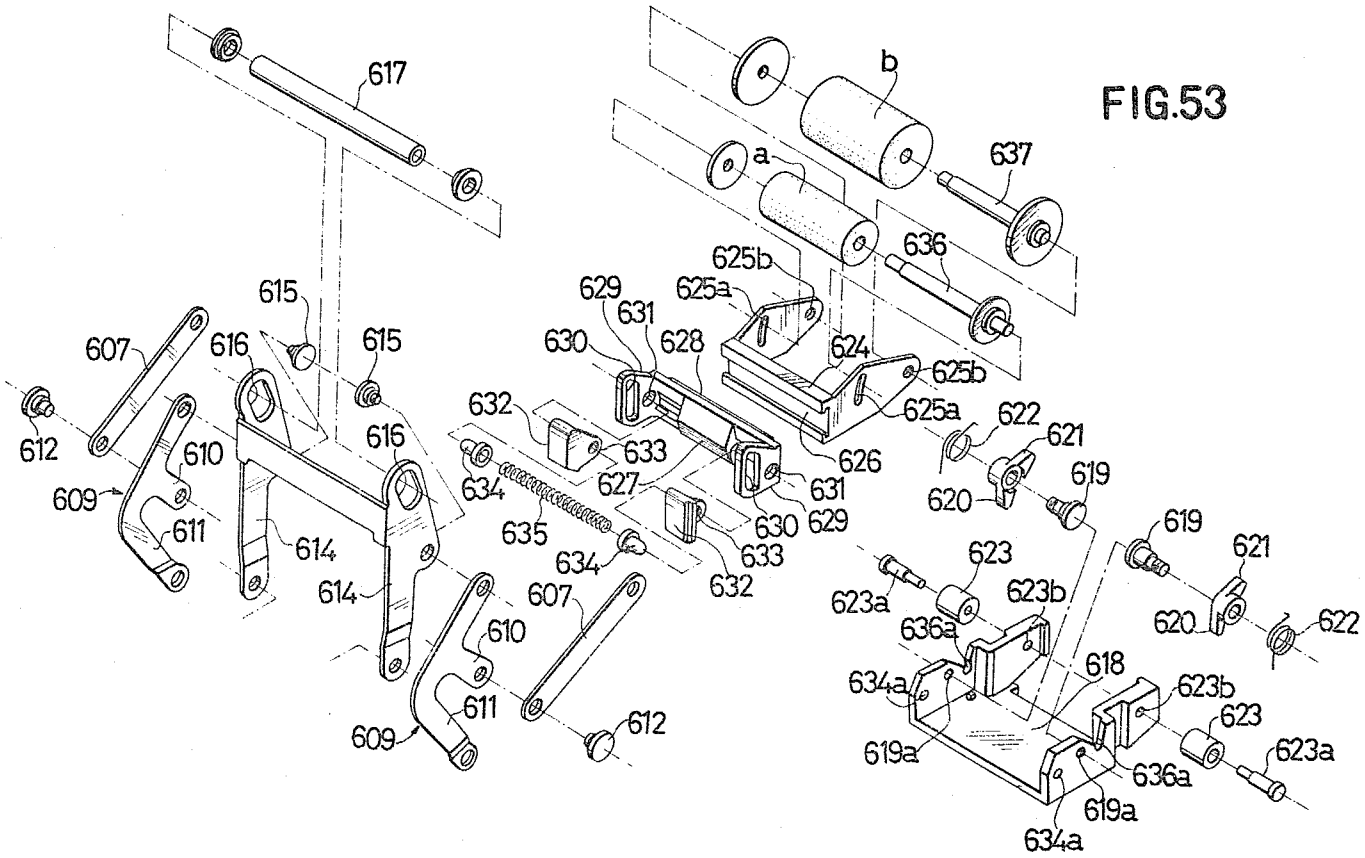
FIG. 53 is an exploded perspective view of the seventh embodiment of the ink supply device.

Referring to FIGS. 51–53, the device A includes a pair of operating links 607, which are pivotally attached at their upper, rearward ends by a pin 608 to the respective outer sides of the paired yokes 606. A pair of F-shaped links 609 are pivotally connected at the ends of their shorter intermediate arms 610 to the lower forward ends of the operating links 607 by respective pins 612. The ends of the longer, lower arms 611 of the links 609 are pivotally connected to a lower forward end portion of the machine frame 602 by a support shaft 613 of the label applicator C. The top rear ends of the vertical arms of the F-shaped links 609 are connected by respective pivot pins 615 to intermediate portions of a pair of spaced apart, opposed, parallel rocking links 614.

The rocking links 614 are affixed together by a web. The rocking links 614 have respective vertically extending slots 616 at their upper portions. A guide shaft 617, which is rotatably supported on the machine frames 602, is slidably received in slots 616, whereby the links 614 may both pivot and shift vertically with respect to shaft 617. The lower portions of the rocking links 614 are pivotally connected by a pair of pins 619 that extend into holes 619*a* to the forward portions of the side walls of a generally pan shaped ink roller casing 618. Casing 618 is fabricated from a synthetic resin material.

Each pin 619 supports a push cam 620 outside both sides of the ink roller casing 618. Each push cam 620 is actuated by a wound torsion spring 622 which is carried on the respective pin 619. The upper or hooked end of each spring 622 presses against the rearward side of the respective projection 621, thereby to bias both cams 620 counterclockwise in FIG. 53, and the lower end of the spring engages the rearward side of a short post on the floor of the ink roller casing 618 just to the rear of opening 619*a*. The holes 619*a* and cams 620 are quite near to and in front of the roller shaft 636 of main ink impregnated roller A, described below. Each spring 622 causes the respecive projection 621 of the respective cam 620 to move into contact with the underside of the roller shaft 636. A pair of guide rollers 623 are attached by pins 623*a* to the outer sides of the rearward portions of the side walls of the ink roller casing 618. The guide rollers 623 roll over a pair of stepped guide means 638 which are formed on the inside of both machine frames 602. The guide means 638 function much as the guide rails and guide grooves of the guide means in the previous embodiments.

A cartridge type ink roller holder 624 is removably mounted in the pan-shaped ink roller case 618. This ink roller holder 624 is preferably fabricated from a synthetic resin. Both of the main ink impregnated inking roller a and the finish ink impregnated inking roller b are rotatably held in the ink roller holder 624.

The main inking roller a is the more forward one and it has a relatively smaller diameter. The finish inking roller b is the trailing roller and it has a relatively larger diameter. This embodiment is not limited to the described roller sizes. The rollers may instead have the same diameters or the positions of the large and small rollers may be reversed. Both inking rollers include foamed, spongy material roller bodies that are impregnated with ink.

The roller shaft 636 of the main inking roller a has opposite ends that extend from both sides of the ink roller holder 624 through slots 625*a* that are formed in the side walls of the ink roller holder 624. Slots 625*a* are vertically elongated, whereby roller shaft 636 may vertically move through the slots 625*a* as the main inking roller a moves over the printing surfaces of the printing head, as described below. The roller shaft 637 of the finish inking roller b extends sideways from roller b so as to fit into attaching holes 625*b* which are formed in the ink roller holder 624. But, shaft 637 does not extend beyond the side walls of the holder 624. At the ends of shaft 637 there are bearing plates for the finish inking roller b, which, as shown in FIG. 52, roll along the underside of the frame of the printing head and define the extent of maximum depression of the types into the finish roller b.

Forward of the ink roller holder 624, there is a pinch holder 627, which is preferably fabricated from a synthetic resin material. The pinch holder 627 has a land 628 formed on its bottom or rear side. This land is sized and shaped to be received in an engaging dovetail groove 626 which is formed on the forward side of the ink roller holder 624.

Both side portions 629 of the pinch holder 627 have a respective vertically elongated aperture 630 therethrough into and out of which a respective pinch member 632 is moved. Both side portions of pinch holder 627 have through holes 631 to the rear of the apertures 630 for receiving a respective one of a pair of retaining members 634. The paired pinch members 632 also have through holes 633, through which the paired retaining members 634 are biased to project by a compression 635 extending between members 634. The retaining members 634 project far enough to releasably engage an opposed pair of engaging holes 634 of the ink roller casing 618 through the holes 631 of the pinch holder 627. The pinch holder 627 is thus releasably held at the forward end of ink roller casing 618.

The side walls of the ink roller casing 618 also have a pair of attaching holes 619*a* behind holes 634*a* in which the pins 619 for the rocking link 614 and for the push cam 620 are fitted. There are a pair of bearing notches 636 in the side walls of the roller casing 618 behind holes 619*a* for receiving the shaft 636 of the main inking roller a. As described below, the shaft 636 is shiftable vertically through the slot 625*a*, whereby it moves into and out of the notches 636*a*. A pair of opposed attached holes 623*b* are formed in the ink roller casing 618 for receiving and affixing the pins 623*a* of the guide rollers 623.

The operation of the seventh embodiment of the ink supply device of the present invention is now described. As the hand lever 603 is gripped toward the grip 601, the ink supply device a is changed from the condition of FIG. 48 or 52 to the condition of FIG. 49. The hand lever and the yokes 606 pivot counterclockwise about the support shaft 604. The operating links 607, which are coactive with the yokes 606, are pushed downward thereby. The F-shaped links 609 are pivoted counterclockwise about their fixed support shaft 613. Then, the rocking links 614, which are attached to and are coactive with the F-shaped links 609 are moved. The rocking links 614 are guided over the guide shaft 617 such that the links 614 are pushed upwardly (compare FIGS. 48 and 49) until the guide shaft 617 engages the lower end of the slot 616. The rocking links 614 are simultaneously pivoted clockwise about the guide shaft 617 until they project forward from the machine body, as shown in FIG. 49. In response to the upward, clockwise motion of the rocking links 614, the ink roller casing 618 pivotally attached thereto is moved forward along with the two inking rollers a and b and the ink roller holder 624. During their forward motion, the two inking rollers a and b roll over the selected printing surface 639 of the printing mechanism B under constant pressure and under appropriately controlled elastic conditions, so as to apply to the printing surface a proper, uniformly distributed amount of ink. The forward, main inking roller a rolls over the printing surface 639 of the printing mechanism B under an elastic pressure exerted upon roller a from below by the push cams 620 which are biased by the springs 622 which are, because the cams are on pin shafts 619, located adjacent to the shaft 636. The shaft 636 also is guided in its motion by the vertically elongated slot 625*a*.

By means of the contact between the main inking roller a and the printing surface 639, the spongy roller body of the ink impregnated roller a is deformed and depressed. Ink, which has been stored in the roller body, is pumped to the surface of the roller and is applied to the printing surface.

In the second or finish step, the trailing, ink impregnated finish roller b is rolled over the printing surface 639, which has already been supplied with ink by the main inking roller a. This distributes the ink uniformly over the printing surface 639. Motion of the finish inking roller b is guided by the guide rollers 623, which are attached to the ink roller casing 618 and which roll along the stepped guide portions 638 formed on the inside walls of the machine frame 2.

The ink impregnated finish roller b is also effective to soak up extra ink that has been applied to the printing surface by the previous passage of the main roller a. The finish roller b also applies its own ink supply to the portions of the printing surface which have not been adequately supplied by the main roller. As a result, application of ink to the printing surface can be uniform.

Figure 50:
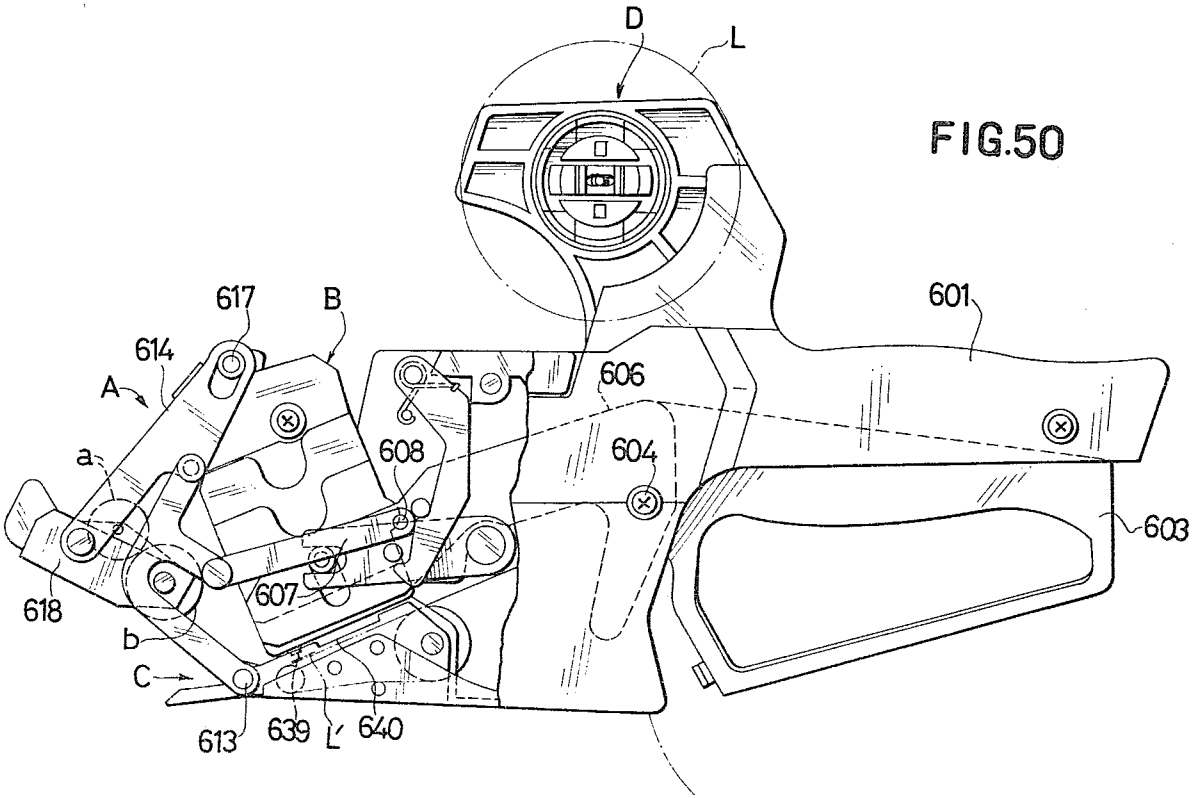
FIG. 50 is a view also similar to FIG. 48 showing the labeling machine when the hand lever is fully gripped and the ink supply device has moved through its full stroke.

Referring to FIG. 50, when the hand lever 603 is gripped to its full stroke, the rocking links 614 are displaced downwardly and clockwise to a position at which the upper end walls of the slots 616 abut against the guide shaft 617. The rocking links 614 then project forward of the frame of the labeler. In response to the forward projection of the rocking links 614, the guide rollers 623 of the ink roller casing 618 disengage from the stepped guide portions 638 of the machine frame, move forward of the frame and they are guided into the space between the shorter intermediate arm 610 and the longer arm 611 of the F-shaped links 609, which also now project forward of the machine frame 602. The guide rollers 623 wait at a position forward of the printing head until the printing operation of the printing mechanism B is completed and the hand lever 603 is released from its gripped condition.

When the hand lever 603 is in its fully gripped condition, the printing mechanism B is moved downward with a predetermined pressure on the label L', which has been fed onto a platen 640. Printing of the label is accomplished with a constant printing pressure. Immediately following the imprinting, the printing surface 639 is held at a position slightly above the label L'. Details of the printing mechanism are not part of the present invention and are thus omitted here. The label L' is supplied to the platen 640 by a feed mechanism E from a continuous label strip A which is held on a label holder D disposed above the machine frame. A more complete description of label supply and feeding may be found in aforesaid application Ser. No. 681,251.

Figure 48:
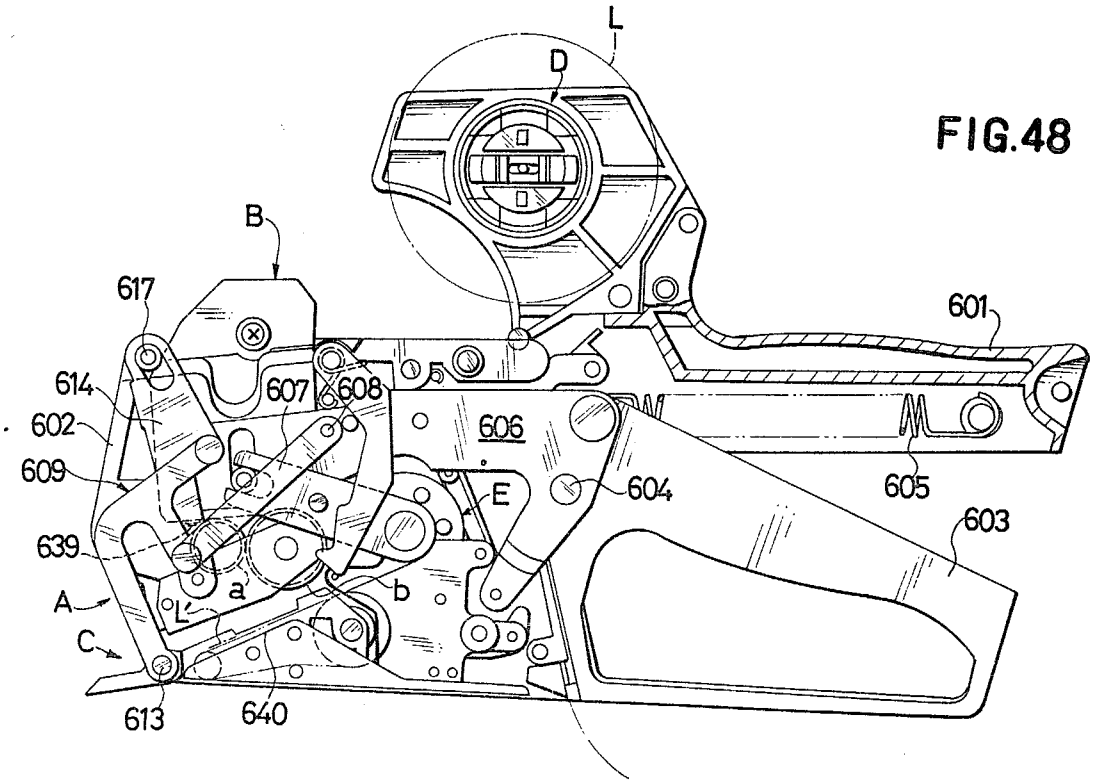
FIG. 48 is a partially cut away, side elevational view of a portable labeling machine exemplifying the seventh embodiment of an inking device according to the present invention with the frame plate of the viewer's side being removed.
Figure 49:
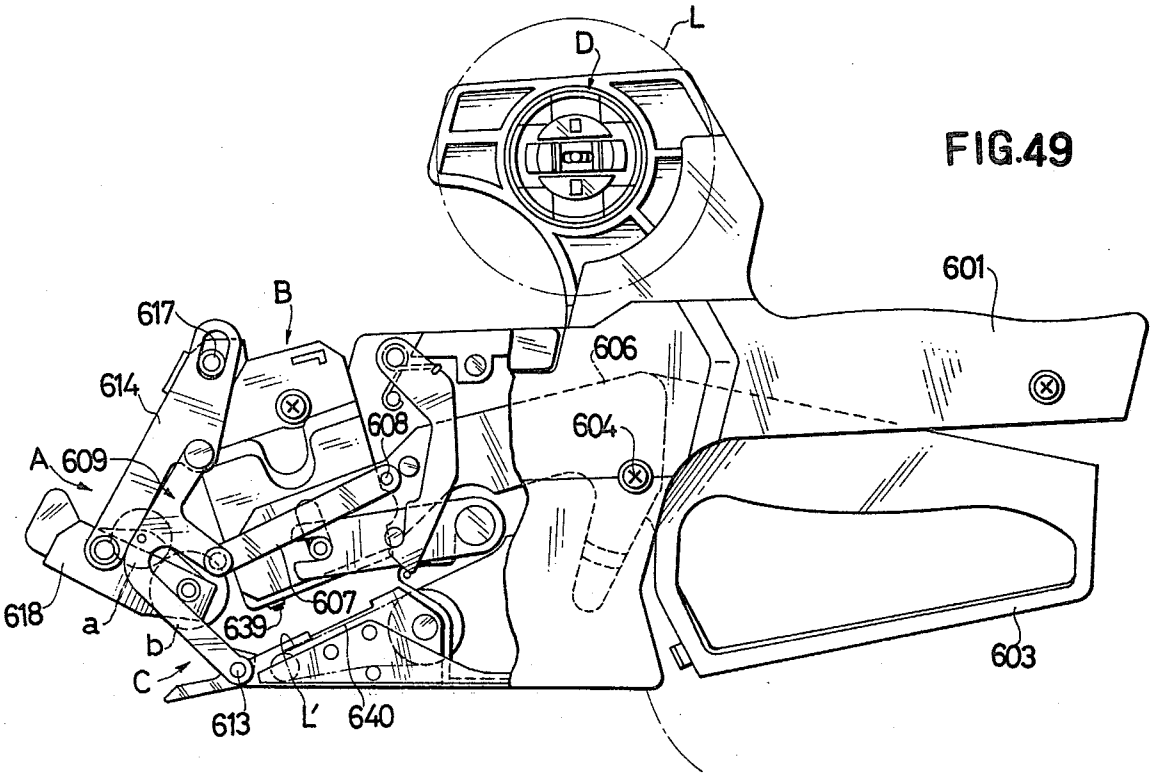
FIG. 49 is a view similar to FIG. 48 showing the labeling machine when the hand lever is partially gripped and the ink supply device is midway through its full stroke.

When the hand lever 603 is released from its gripped condition, the ink supply device A and the printing mechanism B return to their condition of FIG. 48.

The foregoing description of the ink supply device describes at least two ink impregnated rollers, wherein the forward, main roller is biased to rotate against the printing surface of a printing mechanism through the action of a constant pressure biasing means and the trailing, finish roller has its pathway regulated by guide means that force the roller against the printing surface. Because the main roller is not regulated by guide grooves or rails, it can always be biased against the printing surface in proportion to the spring pressure on the push cams 620. Even if the diameter of the main roller changes or is distorted during use of construction of the printing device, e.g., the diameter of the roller is reduced or distorted due to wear, or where the roller diameter is enlarged during ink impregnation, the main ink impregnated roller a can still be biased against the printing surface under regulated conditions. Thus, a sufficient quantity of ink can be applied to the printing surface with constant pressure.

All of the embodiments of the invention have a number of advantages. The ink impregnated bodies of the inking rollers are always forced to rotate over the printing surfaces of the printing head under a constant, regulated pressure. As a result, the quantity of ink supplied to the printing surfaces can be kept constant at all times. Thus, highly precise inking of the types and highly precise printing of the labels can be obtained.

The inking rollers themselves are so constructed and the way in which they are biased against the printing surfaces of the printing heads is so designed that the ink that is at the surface of the rollers and also the ink that is stored deep inside the rollers is all available for use and can be used without any significant waste of ink. Thus, a relatively greater quantity of labels can be imprinted by a single inking roller than was previously possible.

In a number of embodiments, the mechanism for moving the inking rollers has been improved to thereby reduce the force required for gripping of the hand lever to operate the labeler. This reduces possible operator fatigue over prolonged use of the machine.

Other advantages of various embodiments of the invention should be apparent from the foregoing dexcription.

An ink supply device according to any embodiment of the present invention is particularly useful for a labeling machine performing precision printing, such as a machine printing bar codes or characters used for an OCR system.

Although the present invention has been described in connection with a number of preferred embodiments thereof, many variations and modifications will now become apparent to those skilled in the art. It is preferred, therefore, that the present invention be limited not by the specific disclosure herein, but only by the appended claims.

I claim:

1. An inking device for a labeling machine which prints labels;

said labeling machine comprising:

a frame; a printing head in said frame; at least one row of types in said printing head; said types facing toward a print positon;

means for moving said printing head toward and away from a label, whereby said types may contact the label when said types have been moved to the label;

an actuating lever movably connected to said frame to operate said labeling machine;

a yoke attached to said actuating lever and extending toward said printing head; said yoke being movable with said actuating lever; said printing head being secured to said yoke for movement therewith; said yoke having an end surface thereof facing generally in said print direction; through said yoke, said actuating lever being connected to said printing head for moving said printing head toward and away from a label;

said inking device comprising:

an inking roller; support and moving means for moving said inking roller across said types as said printing head moves toward the label and while the label is not in contact with said types;

inking roller guide means comprising a fixedly positioned and immovable guiding element supported on said frame and positioned and shaped to be in engagement with and to guide said inking roller to move over said types on a predetermined pathway with respect to said printing head; said guiding element being positioned and shaped so as to engage said inking roller at a side thereof away from the side contacted by said types and for pressing said inking roller against said types and against force exerted by said types against said inking roller as said inking roller rolls by said types such that the cooperative engagement between said guide means and said inking roller is the sole cause of the inking pressure of said inking roller on said types; said guiding element being shaped and positioned to remain in engagement with said inking roller over the entire said predetermined pathway of said inking roller and also to cause said inking roller to press on said types with a desired pressure over said predetermined pathway;

said yoke end surface being spaced from said guide means such that at least part of said inking roller is normally positioned between them;

said guide means having a first orientation for guiding said inking roller on a pathway that crosses the direction of motion of said yoke; said end surface having a second orientation that is oblique to said first orientation;

a bearing plate connected with said inking roller and movable therewith; said bearing plate normally being in engagement with said yoke end surface, whereby upon motion of said yoke with respect to said guide means, said end surface, pressing upon said bearing plate, shifts said inking roller in one direction along said guide means;

said actuating lever being connected with said inking roller to cause said inking roller to move along said predetermined pathway as said actuating lever is operated.

2. The inking device for a labeling machine of claim 1, wherein said yoke end surface is part of said print head.

3. The inking device for a labeling machine of claim 1, further comprising a pivot on said frame; said actuating lever being pivotally connected on said pivot, whereby said actuating lever pivotally moves with respect to said frame;

an inking roller support between said inking roller and said actuating lever for translating the pivoting motion of said actuating lever into motion of said inking roller along its said predetermined pathway.

4. The inking device for labeling machine of claim 1, wherein the size and placement of said bearing plate with respect to said inking roller determines the location of said inking roller with respect to said end surface and thus determines the pressure that said inking roller can exert upon said types under the influence of said guide means.

5. The inking device for a labeling machine of claim 3, further comprising said yoke having, in addition to said end surface, a separate camming element thereon connectable with said inking roller for moving said inking roller in said one direction.

6. The inking device for a labeling machine of claim 1, wherein said predetermined pathway of said inking roller extends completely across all said types, such that said inking roller is out of the way of contact between a label to be imprinted and said types.

7. The inking device for a labeling machine of claim 6, further comprising a support roller attached to and supporting said inking roller and positioned to engage said guide means over the entire said predetermined pathway, whereby the engagement between said guide means and said inking roller is through said support roller.

8. The inking device for a labeling machine of claim 6, wherein said guide means comprises a slot formed in said frame and extending along said frame past said types over the entire said predetermined pathway.

9. The inking device for a labeling machine of claim 6, wherein said guide means extends along said frame past said types over the entire said predetermined pathway.

10. The inking device for a labeling machine of claim 9, wherein said types are arrayed in a plurality of rows thereof and said guide means extends past all said rows of type.

11. The inking device for a labeling machine of claim 6, wherein said guide means comprise a rail attached to said frame; means attached to said inking roller for engaging said rail and for moving along said rail with said inking roller.

12. The inking device for a labeling machine of claim 11, wherein said means attached to said inking roller for engaging said rail comprises a support roller connected to and supporting said inking roller and positioned to engage said rail.

13. The inking device for a labeling machine of claim 29, wherein said support roller engages said rail on the side thereof facing said end surface.

14. The inking device for a labeling machine of claim 1, further comprising biasing means operating upon said inking roller in the direction opposite said one direction.

15. The inking device for a labeling machine of claim 14, further comprising a rocker arm pivotally attached to said machine frame and to said inking roller for supporting said inking roller to said machine frame; said rocker arm being pivotable with respect to said frame as said inking roller moves along said guide means.

16. The inking device for a labeling machine of claim 15, further comprising said yoke having a camming element thereon positioned to be engageable with said rocker arm upon motion of said yoke in a particular direction and said camming element being so positioned as to engage and move said rocker arm to move said inking roller in its said one direction.

17. The inking device for a labeling machine of claim 16, further comprising a cam follower surface on said rocker arm and positioned to be engaged by said camming element and to have said camming element slide over said cam follower surface as said yoke is moved in its respective direction and as said yoke pivots said rocker arm.

18. The inking device for a labeling machine of claim 17, wherein said end surface and said guide means are so positioned that motion of said inking roller in its said one direction occurs upon motion of said end surface toward said guide means.

19. The inking device for a labeling machine of claim 15, further comprising an ink roller frame to which said inking roller is pivotally mounted; said inking roller being pivotally connected to said rocker arm through said ink roller frame.

20. The inking device for a labeling machine of claim 19, wherein said ink roller frame includes attachment pieces for being received by a support member; a support member for receiving said attachment pieces; said support member being affixed to said rocker arm.

21. The inking device for a labeling machine of claim 20, wherein said ink roller frame is generally U-shaped, having two spaced legs and a web joining said legs; said inking roller extending across said web of said ink roller frame; said attachment pieces being respectively on each leg of said ink roller frame; said legs of said ink roller frame being resiliently deflectable, thereby to enable separation of said ink roller frame from its said support member by resilient deflection of said ink roller frame legs to move said attachment pieces off their said receiving means.

22. The inking device for a labeling machine of claim 1, further comprising said yoke having, in addition to said end surface, a separate camming element thereon connectable with said inking roller for moving said inking roller in said one direction.

23. An inking device for a labeling machine which prints labels:

said labeling machine comprising:

a frame; a printing head; said types facing toward a print position;

means for moving a label and said types relative to each other to contact the label against said types and to move the label away from said types;

an actuating lever movably connected to said frame to operate said labeling machine;

said inking device comprising:

an inking roller; support and moving means for moving said inking roller across said types when the label is not in contact with said types;

inking roller guide means in said frame positioned and shaped to be in engagement with and to guide said inking roller to move over said types on a predetermined pathway with respect to said printing head, said guide means to remain in engagement with said inking roller over the entire said predetermined pathway of said inking roller, thereby to cause said inking roller to press on said types with a desired pressure;

said actuating lever being connected with said inking roller to cause said inking roller to move along said predetermined pathway as said actuating lever is operated; a pivot on said frame; said actuating lever being pivotally connected on said pivot, whereby said actuating lever pivotally moves with respect to said frame;

an inking roller support between said inking roller and said actuating lever for translating the pivoting motion of said actuating lever into motion of said inking roller along its said predetermined pathway; said inking roller support comprises:

a yoke attached to said actuating lever for pivoting with said actuating lever;

a drive lever pivotally connected to said machine at one pivot on said drive lever and pivotally connected to said yoke at another pivot on said drive lever;

a rocking lever pivotally connected to said machine frame at one respective pivot on said rocking lever and pivotally connected to said drive lever at another respective pivot on said rocking lever and pivotally connected to said inking roller at yet another respective pivot on said rocking lever.

24. The inking device for a labeling machine of claim 23, wherein said printing head is fixedly attached to said machine frame;

a platen normally located opposed to said types at said print position;

lever means joining said platen to said actuating lever for moving said platen to said types upon motion of said actuating lever.

25. An inking device for a labeling machine which prints labels:

said labeling machine comprising:

a frame; a printing head in said frame; at least one row of types in said printing head; said types facing toward a print position;

an actuating lever movably connected to said frame to operate said labeling machine;

said linking device comprising:

an inking roller; support and moving means for moving said inking roller across said types when the label is not in contact with said types;

inking roller guide means comprising a fixedly positioned and immovable guiding element supported on said frame and positioned and shaped to be in engagement with and to guide said inking roller to move over said types on a predetermined pathway with respect to said printing head; said guiding element being positioned for urging said inking roller toward said types against force exerted by said types against said inking roller as said inking roller rolls by said types; said guiding element being shaped and positioned to remain in engagement with said inking roller over the entire said predetermined pathway of said inking roller, thereby to cause said inking roller to press on said types with a desired pressure;

said actuating lever being connected with said inking roller to cause said inking roller to move along said predetermined pathway as said actuating lever is operated;

a yoke attached to said actuating lever and extending toward said printing head; said yoke being movable with said actuating lever; said printing head being secured to said yoke for movement therewith for moving a label and said types relative to each other to contact the label against said types and to move the label away from said types;

said yoke having an end surface therewith facing generally in said print direction; said yoke end surface being spaced from said guide means such that at least part of said inking roller is normally positioned between them;

said guide means having a first orientation for guiding said inking roller on a pathway that crosses the direction of motion of said yoke; said end surface having a second orientation that is oblique to said first orientation;

a bearing plate connected with said inking roller and movable therewith; said bearing plate normally being in engagement with said yoke end surface, whereby upon motion of said yoke with respect to said guide means, said end surface, pressing upon said bearing plate, shifts said inking roller in one direction along said guide means;

said end surface and said guide means are so positioned that motion of said inking roller in its said one direction occurs upon motion of said end surface toward said guide means.

26. The inking device for a labeling machine of claim 25, further comprising a platen that is normally located opposed to said types; said yoke being movable toward said platen; movement of said yoke toward said platen causes said types to print upon a label located on said platen.

27. An inking device for a labeling machine which prints labels:

said labeling machine comprising:

a machine frame; a printing head in said machine frame; at least one row of types in said printing head; said types facing toward a print position;

means for moving a label and said types relative to each other to contact the label against said types and to move the label away from said types;

an actuating lever movably connected to said machine frame to operate said labeling machine;

said inking device comprising:

an inking roller; support and moving means for moving said inking roller across said types when the label is not in contact with said types;

inking roller guide means in said machine frame and positioned and shaped to be in engagement with and to guide said inking roller to move over said types on a predetermined pathway with respect to said printing head, said guide means to remain in engagement with said inking roller over the entire said predetermined pathway of said inking roller, thereby to cause said inking roller to press on said types with a desired pressure;

said actuating lever being connected with said inking roller to cause said inking roller to move along said predetermined pathway as said actuating lever is operated; a pivot on said machine frame; said actuating lever being pivotally connected on said pivot, whereby said actuating lever pivotally moves with respect to said machine frame;

an inking roller support between said inking roller and said actuating lever for translating the pivoting motion of said actuating lever into motion of said inking roller along its said predetermined pathway; said inking roller support comprises:

a yoke attached to said actuating lever for pivoting with said actuating lever; a drive link having one end connected to said yoke for being movable therewith and being pivotally connected thereto for pivoting with respect thereto;

a rocking link pivotally connected to said machine frame for pivoting with respect thereto;

said drive link having another end pivotally connected to said rocking link, such that motion of said drive link under the influence of said yoke pivots and rocks said rocking link about its said pivot connected to said frame;

a rocking frame, which is pivotally connected at a rocking frame pivot on said machine frame to be pivotable with respect to said machine frame and which is pivotally connected to said rocking link such that pivoting of said rocking link about its said pivot causes said rocking frame to pivot about its said pivot; said inking roller being connected with said rocking frame at a location spaced from said rocking frame pivot, whereby pivoting of said rocking frame about said rocking frame pivot shifts said linking roller along said pathway defined by said guide means.

28. The inking device for a labeling machine of claim 27, wherein said rocking frame includes an elongated slot and said rocking frame pivot connection comprises a shaft supported on said machine frame and passing through said elongated slot, such that said rocking frame both pivots about said rocking frame pivot and moves with respect to said rocking frame pivot connection shaft passing through said slot in said rocking frame, thereby to compensate for said rocking frame pivot connection shaft remaining stationary as said rocking frame pivots under the influence of said rocking link.

29. The inking device for a labeling machine of claim 28, wherein said rocking link is F-shaped with the end of its main shaft being connected with said rocking frame, with the end of its intermediate crossbar being connected with said drive link and with the end of the end crossbar being pivotally connected to said machine frame.

30. The inking device for a labeling machine of claim 29, wherein said rocking frame has a generally hatchet head shaped portion in which said elongated slot for said rocking frame pivot shaft is positioned and to which said rocking link is pivotally connected.

31. An inking device for a labeling machine which prints labels:

said labeling machine comprising:

a frame; a printing head in said frame; at least one row of types in said printing head; said types facing toward a print position;

means for moving a label and said types relative to each other to contact the label against said types and to move the label away from said types;

an actuating lever movably connected to said frame to operate said labeling machine;

said inking device comprising:

two inking rollers, each having a respective axis and said axes of said printing rollers being parallel; support and moving means for moving both said inking rollers across said types when the label is not in contact with said types;

inking roller guide means in said frame positioned and shaped to be in engagement with and to guide said inking rollers to move over said types along a predetermined pathway with respect to said printing heads, said guide means to remain in engagement with said inking rollers over the entire said predetermined pathway of said inking rollers over said types thereby to cause said inking rollers to press against said types with a desired pressure;

said actuating lever being connected with said inking rollers to cause said inking rollers to move along said predetermined pathway as said actuating lever is operated; said actuating lever causing said inking rollers to shift in one operative direction over the entire said predetermined pathway of said inking rollers, thereby to ink said types by motion of said inking rollers in said one operative direction;

a supporting assembly for said inking rollers; said actuating lever being connected with said inking rollers by being connected with said supporting assembly; said supporting assembly comprising:

an ink roller holder; both said inking rollers being attached to said holder; said actuating lever being connected with said inking rollers by being connected to said holder;

biasing means on said holder and in engagement with the said roller that leads in motion in said one operative direction, said biasing means being for biasing the leading said roller toward said types against movement of that said roller caused by the profiles of said types;

a support shaft on and for the leading said inking roller in said one operative direction;

said holder having a guide formation thereon for enabling guidance of motion of that said inking roller with respect to said holder under the influence of said biasing means and the influence of the profiles of said types;

said guide formation on said holder comprises an elongated slot, which is elongated along the pathway in which the leading said inking roller is biased by said biasing means and said types; said support shaft for the leading said inking roller riding in and being guided in the said elongated slot in said holder.

32. An inking device for a labeling machine which prints labels:

said labeling machine comprising:

a frame; a printing head in said frame; at least one row of types in said printing head; said types facing toward a print position;

means for moving a label and said types relative to each other to contact the label against said types and to move the label away from said types;

an actuating lever movably connected to said frame to operate said labeling machine;

said inking device comprising:

two inking rollers, each having a respective axis and said axis of said printing rollers being parallel; support and moving means for moving both said inking rollers across said types when the label is not in contact with said types;

inking roller guide means comprising a fixedly positioned and immovable guiding element supported on said frame and positioned and shaped to be in engagement with and to guide said inking rollers to move over said types along a predetermined pathway with respect to said printing heads; said guide means being positioned for urging said inking rollers toward said types and against force exerted by said types against said inking rollers as said inking rollers roll by said types; said guide means being adapted to remain in engagement with said inking rollers over the entire said predetermined pathway of said inking rollers over said types, thereby to cause said inking rollers to press against said types with a desired pressure;

said actuating lever being connected with said inking rollers to cause said inking rollers to move along said predetermined pathway as said actuating lever is operated;

said actuating lever causing said inking rollers to shift in one operative direction over the entire said predetermined pathway of said inking rollers, thereby to ink said types by motion of said inking rollers in said one operative direction;

a supporting assembly for said inking rollers; said actuating lever being connected with said inking rollers by being connected with said supporting assembly; said supporting assembly comprising:

an ink roller holder; both said inking rollers being attached to said holder; said actuating lever being connected with said inking rollers by being connected to said holder;

biasing means on said holder and in engagement with the said roller that leads in motion in said one operative direction, said biasing means being for biasing the leading said roller toward said types against movement of that said roller caused by the profiles of said types;

a support shaft on and for the leading said inking roller in said one operative direction;

said holder having a guide formation thereon for enabling guidance of motion of that said inking roller with respect to said holder under the influence of said biasing means and the influence of the profiles of said types;

a rocking link pivot on said frame; a rocking link pivotally supported on said rocking link pivot; said actuating lever being connected with said rocking link to cause same to pivot; said rocking link being joined to said ink roller holder for causing said ink roller holder to move along said guide means and to move said inking rollers over said types as said actuating lever is operated;

the manner of engagement of said inking rollers with said guide means comprises a support roller attached to and supporting said ink roller holder; said support roller being positioned to engage said guide means over the pathway of said ink roller holder along said guide means.

33. The inking device for a labeling machine of claim 32, wherein said printing head has a lower surface that faces toward the print position;

a bearing plate connected with one said roller and movable therewith; said bearing plate normally being in engagement with said lower surface of said printing head, wherein the size and placement of said bearing plate with respect to its respective said inking roller determines the location of that said inking roller with respect to said printing head lower surface and thus determines the pressure that that said inking roller can exert upon said types as it rolls thereover.

34. The inking device for a labeling machine of claim 33, wherein said bearing plate is on the said inking roller that is the trailing inking roller as said inking rollers move in said one operative direction.

35. An inking device for a labeling machine which prints labels:

said labeling machine comprising:

a frame; a printing head in said frame; at least one row of types in said printing head; said types facing toward a print position;

means for moving said printing head toward and away from a label, whereby said types may contact the label when said types have been moved to the label;

an actuating lever movably connected to said frame to operate said labeling machine; said actuating lever being connected to said printing head for moving it toward and away from a label;

said inking device comprising:

an inking roller and a holder therefor; an inking roller holder pivot on said inking roller holder on which said pivot said inking roller is pivotally supported;

a holder frame; holder frame support means on said holder frame for removably engaging said inking roller holder and for holding said inking roller holder to said holder frame;

means attaching said holder frame to said actuating lever for moving said inking roller across said types as said printing head moves toward the label and while the label is not in contact with said types;

inking roller guide means comprising a fixedly positioned and immovable guiding element supported on said frame and positioned and shaped to be in engagement with and to guide said inking roller to move over said types on a predetermined pathway with respect to said printing head; said guiding element being positioned and shaped so as to engage said inking roller at a side thereof away from the side contacted by said types and for pressing said inking roller against said types and against force exerted by said types against said inking roller as said inking roller rolls by said types such that the cooperative engagement between said guide means and said inking roller is the sole cause of the inking pressure of said inking roller on said types; said guiding element being shaped and positioned to remain in engagement with said inking roller over the entire said predetermined pathway of said inking roller and also to cause said inking roller to press on said types with a desired pressure over said predetermined pathway.

36. The inking device for a labeling machine of claim 35, further comprising:

a support roller for said holder frame; said support roller being in engagement with said guide means, whereby said support roller provides the said engagement between said inking roller and said guide means;

a guide pin projecting from said holer frame; said support roller being rotatably mounted on said guide pin.

37. An inking device for a labeling machine which prints labels:

said labeling machine comprising:

a frame; a printing head in said frame; at least one row of types in said printing head; said types facing toward a print position;

means for moving said printing head toward and away from a label, whereby said types may contact the label when said types have been moved to the label;

an actuating lever movably connected to said frame to operate said labeling machine;

a yoke attached to said actuating lever and extending toward said printing head; said yoke being movable with said actuating lever; said printing head being secured to said yoke for movement therewith; said yoke having an end surface thereof facing generally in said print direction; through said yoke, said actuating lever being connected to said printing head for moving said printing head toward and away from a label;

said inking device comprising:

an inking roller; support and moving means for moving said inking roller across said types as said printing head moves toward the label and while the label is not in contact with said types;

inking roller guide means comprising a fixedly positioned and immovable guiding element supported on said frame and positioned and shaped to be in engagement with and to guide said inking roller to move over said types on a predetermined pathway with respect to said printing head; said guiding element being positioned and shaped so as to engage said inking roller at a side thereof away from the side contacted by said types and for pressing said inking roller against said types and against force exerted by said types against said inking roller as said inking roller rolls by said types such that the cooperative engagement between said guide means and said inking roller is the sole cause of the inking pressure of said inking roller on said types; said guiding element being shaped and positioned to remain in engagement with said inking roller over the entire said predetermined pathway of said inking roller and also to cause said inking roller to press on said types with a desired pressure over said predetermined pathway;

said yoke end surface being spaced from said guide means such that at least part of said inking roller is normally positioned between them;

a bearing plate connected with said inking roller and movable therewith; said bearing plate normally being in engagement with said yoke end surface; said actuating lever being connected with said inking roller to move said inking roller in one direction along said guide means, whereby upon motion of said yoke with respect to said guide means the size and placement of said bearing plate with respect to said inking roller determines the location of said inking roller with respect to said yoke end surface and thus determines the pressure that said inking roller can exert upon said types under the influence of said guide means;

said actuating lever being connected with said inking roller to cause said inking roller to move along said predetermined pathway as said actuating lever is operated.

38. An inking device for a labeling machine which prints labels;

said labeling machine comprising:

a frame; a printing head in said frame; at least one row of types in said printing head; said types facing toward a print position;

means for moving said printing head toward and away from a label; whereby said types may contact the label when said types have been moved to the label;

an actuating lever pivotally connected to said frame at a pivot on said frame, whereby said actuating lever pivotally moves with respect to said frame; said actuating lever being for operating said labeling machine; said actuating lever being connected to said printing head for moving it toward and away from a label;

said inking device comprising:

an inking roller; support and moving means between said inking roller and said actuating lever for translating the pivoting motion of said actuating lever into motion of said inking roller along a predetermined pathway, for moving said inking roller across said types as said printing head moves toward the label and while the label is not in contact with said types; said predetermined pathway of said inking roller extends completely across all said types, such that said inking roller is out of the way of contact between a label to be imprinted and said types; under the influence of said actuating lever, said inking roller is movable in one operative direction for engaging and inking said types;

inking roller guide means comprising a fixedly positioned and immovable guiding element supported on said frame and positioned and shaped to be in engagement with and to guide said inking roller to move over said types on a predetermined pathway with respect to said printing head;

a support roller attached to and supporting said inking roller and positioned to engage said guide means over the entire said predetermined pathway; said guilding element being positioned and shaped so as to engage said inking roller support roller at a side thereof away from the side contacted by said types and for thereby pressing said inking roller against said types and against force exerted by said types against said inking roller as said inking roller rolls by said types such that the cooperative engagement between said guide means and said inking roller support roller is the sole cause of the inking pressure of said inking roller on said types; said guiding element being shaped and positioned to remain in engagement with said inking roller support roller over the entire said predetermined pathway of said inking roller and also to cause said inking roller to press on said types with a desired pressure over said predetermined pathway;

said inking roller support roller being eccentric to said inking roller, with the axis of said support roller being behind said inking roller in said operative direction, whereby said support roller may continue to engage said guide means after said inking roller has moved in said operative direction beyond said types;

said actuating lever being connected with said inking roller to cause said inking roller to move along said predetermined pathway as said actuating lever is operated.

39. An inking device for a lbeling machine which rints labels:

said labeling machine comprising:

a frame; a printing head in said frame, at least one row of types in said printing head; said types facing toward a print position;

means for moving said printing head toward and away from a label whereby said types may contact the label when said types have been moved to the label;

an actuating lever movable connected to said frame to operate said labeling machine; said actuating lever being connected to said printing head for moving it toward and away from a label;

said inking device comprising:

two inking rollers, each having a respective axis and said axes of said printing rollers being parallel;

an inking roller holder; both said inking rollers being attached to said holder; said actuating lever being connected with said inking rollers by being connected to said holder for moving both said inking rollers across said types as said printing head moves toward the label and while the label is not in contact with said types;

said actuating lever causes said inking rollers to shift in one operative direction over the entire said predetermined pathway of said inking rollers, thereby to ink said types by motion of said inking rollers in said one operative direction;

biasing means on said holder and in engagement with the said roller that leads in motion in said one operative direction, said biasing means being for biasing the leading said roller toward said types against movement of that said roller caused by the profiles of said types;

a support shaft on and for the leading said inking roller in said one operative direction;

inking roller guide means comprising a fixedly positioned and immovable guiding element supported on said frame and positioned and shaped to be in engagement with and to guide said inking rollers to move over said types along a predetermined pathway with respect to said printing heads; said guide means being positioned and shaped so as to engage at least one of said inking rollers at a side thereof away from the side contacted by said types and for pressing said at least one inking roller against said types and against force exerted by said types against said inking rollers as said inking rollers roll by said types such that the cooperative engagement between said guide means and said at least one inking roller is the sole cause of the inking pressure of said at least one inking roller on said types; said guilding element being adapted to remain in engagement with said at least one inking roller over the entire said predetermined pathway of said inking roller over said types and also to cause said inking rollers to press against said types with a desired pressure over said predetermined pathway; a rocking link pivot on said frame;

a rocking link pivotally supported on said rocking link pivot; said actuating lever being connected with said rocking link to cause same to pivot; said rocking link being joined to said ink roller holder for causing said ink roller holder to move along said guide means and to move said inking rollers over said types as said actuating lever is operated.

40. The inking device for a labeling machine of claim 39, further comprising a supporting pan for said holder, and said holder being positioned in and connected to said pan to move therewith; said rocking link being connected to said holder by being connected to said pan;

said support roller being connected to said holder by being connected to said pan;

said biasing means for engaging the leading one of said inking rollers as said inking rollers move in said one operative direction, extends between said pan and that said inking roller.

41. An inking device for a labeling machine which prints labels:

said labeling machine comprising:

a frame; a printing head in said frame; at least one row of types in said printing head; said types facing toward a print position;

means for moving said printing head toward and away from a label whereby said types may contact the label when said types have been moved to the label;

an actuating lever movably connected to said frame to operate said labeling machine;

a yoke to which said printing head is attached; said yoke having an end surface thereof facing generally in said print direction; through said yoke, said actuating lever being connected to said printing head for moving said printing head toward and away from a label;

said inking device comprising:

an inking roller; support and moving means for moving said inking roller across said types as said printing head moves toward the label and while the label is not in contact with said types;

inking roller guide means comprising a fixedly positioned and immovable guiding element supported on said frame and positioned and shaped to be in engagement with and to guide said inking roller to move over said types on a predetermined pathway with respect to said printing head; said guiding element being positioned and shaped so as to engage said inking roller at a side thereof away from the side contacted by said types and for pressing said inking roller against said types and against force exerted by said types against said inking roller as said inking roller rolls by said types such that the cooperative engagement between said guide means and said inking roller is the sole cause of the inking pressure of said inking roller on said types; said guiding element being shaped and positioned to remain in engagement with said inking roller over the entire said predetermined pathway of said inking roller and also to cause said inking roller to press on said types with a desired pressure over said predetermined pathway;

said yoke end surface being spaced from said guide means such that at least part of said inking roller is normally positioned between them;

said guide means comprising a fixedly positioned, immovable guiding element supported on said frame; said guide means having a first orientation for guiding said inking roller on a pathway that crosses the direction of relative motion of the labels toward and away from said types; said end surface having a second orientation that is oblique to said first orientation;

a bearing plate connected with said inking roller and movable therewith; said bearing plate normally being in engagement with said yoke end surface, whereby upon relative motion of a label and said types toward each other, said end surface presses upon said bearing plate as said inking roller shifts in one direction along said guide means;

said actuating lever being connected with said inking roller to cause said inking roller to move along said predetermined pathway as said actuating lever is operated.

42. The inking device for a labeling machine of claim 41, wherein said yoke end surface is part of said printing head.

43. The inking device for a labeling machine of claim 42, further comprising a pivot on said frame; said actuating lever being pivotally connected on said pivot, whereby said actuating lever pivotally moves with respect to said frame;

an inking roller support between said inking roller and said actuating lever for translating the pivoting motion of said actuating lever into motion of said inking roller along its said predetermined pathway.

44. The inking device for a labeling machine of claim 43, wherein the size and placement of said bearing plate with respect to said inking roller determines the location of said inking roller with respect to said end surface and thus determines the pressure that said inking roller can exert upon said types under the influence of said guide means.

* * * * *